United States Patent [19]

Wright

[11] Patent Number: 5,032,154

[45] Date of Patent: Jul. 16, 1991

[54] FLUE GAS CONDITIONING SYSTEM

[75] Inventor: Robert A. Wright, Indianapolis, Ind.

[73] Assignee: Wilhelm Environmental Technologies, Inc., Indianapolis, Ind.

[21] Appl. No.: 494,234

[22] Filed: Mar. 15, 1990

Related U.S. Application Data

[63] Continuation-in-part of Ser. No. 337,950, Apr. 14, 1989, abandoned.

[51] Int. Cl.[5] ..... B03C 3/66

[52] U.S. Cl. ..... 55/106; 55/5

[58] Field of Search ..... 55/5, 106

[56] References Cited

U.S. PATENT DOCUMENTS

| | | | |
|---|---|---|---|
| 2,864,456 | 12/1958 | Hall et al. | 183/7 |
| 3,284,990 | 11/1966 | Orne | 55/5 |
| 3,523,407 | 8/1970 | Humbert | 55/106 |
| 3,665,676 | 5/1972 | McKewen | 55/4 |
| 3,686,825 | 8/1972 | Busby | 55/5 |
| 3,689,213 | 9/1972 | Guerrieri | 55/5 |
| 3,722,178 | 3/1973 | Aaland et al. | 55/4 |
| 3,993,429 | 11/1976 | Archer | 431/5 |
| 4,042,348 | 8/1977 | Bennett et al. | 55/5 |
| 4,284,417 | 8/1981 | Reese et al. | 55/2 |
| 4,333,746 | 6/1982 | Southam | 55/106 |
| 4,466,815 | 8/1984 | Southam | 55/122 |
| 4,533,364 | 8/1985 | Altman et al. | 55/5 |
| 4,624,685 | 11/1986 | Lueckenotte et al. | 55/13 |
| 4,770,674 | 9/1988 | Tellini et al. | 55/5 |
| 4,779,207 | 10/1988 | Woracek | 364/500 |
| 4,844,723 | 7/1989 | Tellini et al. | 55/106 |

OTHER PUBLICATIONS

Sulfur Trioxide Conditioning, Journal of Air Pollution Control Association, vol. 25, No. 2, Feb. 1975, pp. 156–158.

*Primary Examiner*—Charles Hart

*Attorney, Agent, or Firm*—Willian Brinks Olds Hofer Gilson & Lione

[57] ABSTRACT

$SO_3$ flue gas-condition systems provide a controlled flow of flue gas-conditioning agent such as $SO_3$ into a boiler flue gas and its entrained particulate material ahead of an electrostatic precipitator. The systems monitor the opacity of the stack effluent and operate to maintain a flow of $SO_3$-conditioning agent into the boiler flue gas to provide minimal opacity of the stack effluent. The systems operate to hunt and operate at $SO_3$-conditioning agent flow rate corresponding to minimal opacity of the stack effluent and to eliminate corrections that may be due to transient operating conditions such as boiler upsets, precipitator rapping and the like. The systems include features providing improved conversion of $SO_2$ *1 into* $SO_3$, integrated assemblies to provide $SO_2$ from sulfur and sulfur dioxide conversion units adapted to convert $SO_2$ into $SO_3$ at a plurality of remote $SO_3$ injection sites.

18 Claims, 13 Drawing Sheets

FLUE GAS CONDITIONING SYSTEM

This is a continuation-in-part of U.S. patent application Ser. No. 07/337,950 filed Apr. 14, 1989 and now abandoned.

TECHNICAL FIELD

This invention relates to a system for treating particulate-ladened boiler flue gas with a conditioning agent to improve the removal of particulate matter by electrostatic means and, more particularly, relates to an $SO_3$ flue gas-conditioning system which operates automatically to obtain minimal opacity of the flue gas effluent to atmosphere.

BACKGROUND ART

Electrical utilities must burn increasing quantities of fossil fuels to satisfy the ever-increasing demand for electric power. At the same time, electric utilities face increasing clean-air standards that are imposed upon their operation. In trying to satisfy the divergent demands of increasing power and decreased air pollution, electrical utilities have turned to using low-sulfur coals to fire their boilers and generate the steam needed for electrical power generation.

Electrical utilities have long relied upon electrostatic means such as electrostatic precipitators to remove particulate matter from boiler flue gas. The efficiency of operation of the electrostatic precipitators in the removal of particulate matter from boiler flue gas is dependent, in part, upon the electrical resistivity of the entrained particulate matter in boiler flue gas. It has been found that where a boiler is fired with low-sulfur coals, that is, coals having less than one percent sulfur content, the entrained particulate matter in the boiler flue gas has a high resistivity, for example, $10^{13}$ ohm-cm resistance and more. It has also been determined that the most efficient removal of particulate matter by electrostatic precipitation occurs when its resistivity is on the order of about $10^8$ ohm-cm and that when the resistivity of the particulate matter is higher, for example, on the order of $10^{13}$ ohm-cm, the efficiency of electrostatic precipitation is substantially reduced. Thus, reduced efficiency in the operation of electrostatic precipitators with the flue gas from low-sulfur coals has been attributed to the higher resistivity of such flue gas particles. Any reduction of the ability of an electrostatic precipitator to remove particles from the flue gas can offset, of course, the reduced or potentially reduced air pollution sought through the use of the more expensive low-sulfur coals.

One solution to this problem has been to condition the boiler flue gas prior to its entrance into the electrostatic precipitator by the use of a conditioning agent to reduce the resistivity of the entrained particles within the boiler flue gas. Among the various chemicals which have been used as conditioning agents for boiler flue gas are water, anhydrous ammonia and various ammonia-bearing solutions, sulfuric acid, sulfur trioxide and phosphoric acid.

U.S. Pat. No. 2,864,456 discloses an automatic control for electrostatic precipitators which varies both the electrostatic precipitator voltage and the supply of a conditioning agent such as water for particles to be removed by the electrostatic precipitator, to maintain an optimum sparking rate for efficient particle removal.

U.S. Pat. No. 3,284,990 discloses a method of improving the electrostatic precipitation of particles by adding phosphorous pentoxide to the particles prior to their electrostatic precipitation.

U.S. Pat. No. 3,523,407 discloses a method of improving the electrostatic precipitation of particles from a flue gas by adding preselected amounts of ammonia and water to the flue gas.

U.S. Pat. No. 3,665,676 discloses a system to condition the particles of boiler flue gas by the use of a salt solution such as a solution of ammonium sulfate or ammonium bisulfate. The salt solution is injected into the flue gas prior to entering the electrostatic precipitator and the system includes a metering means for controlling the amount of conditioner injected into the flue gas. U.S. Pat. No. 3,665,676 indicates that, if desired, conventional automatic controls can be provided to open the metering means when the flue gas reaches the desired operating temperature or to close it should the temperature fall below operating temperature. In addition, automatic controls can also be made to open the metering means to provide the amount of conditioner needed in proportion to the volume of gas to be conditioned.

U.S. Pat. No. 3,689,213 discloses a process for treating flue gas in which gaseous sulfur trioxide is generated in the immediate vicinity of the point of use as required by the quantity of fossil fuel being burned per unit time and is then introduced into the flue gas at a predetermined rate to facilitate fly ash removal by an electrostatic precipitator. In the system of U.S. Pat. No. 3,689,213, air and gaseous sulfur dioxide are heated in a heat exchanger to a temperature required for oxidation of sulfur dioxide to sulfur trioxide. The air and sulfur dioxide are passed through a catalytic converter for conversion of the sulfur dioxide to sulfur trioxide prior to its injection into the boiler flue gas.

U.S Pat. No. 3,722,178 discloses a system for the production of sulfur trioxide for flue gas conditioning including means to deliver a source of sulfur such as sulfuric acid to a vaporizer in proportion to the amount of flue gas from the boiler measured in terms of the electrical output generated at a particular time. As the production of flue gas changes in the boiler system, the proper ratio of acid to flue gas is automatically maintained by a control responsive to a signal coming from a boiler capacity index gauge to control the volume of sulfur trioxide being produced. The vaporizer is provided with a mixture of fresh air and a combustion gas from a natural gas or oil to convert the sulfuric acid to sulfur trioxide. The amount of combustion gas directed into the combustion chamber is automatically controlled by the exit temperature of the sulfur trioxide as indicated by temperature controllers mounted at the top and bottom of the vaporizer in the path of the output gas. The temperature controllers maintain the temperature of the vaporizer in the range for efficient production of sulfur trioxide. An additional temperature controller at the exit of the vaporizer turns off the burner when the temperature at the exit exceeds 1200° F. (649° C.).

More recent developments have centered on sulfur trioxide as a flue gas-conditioning material. Such flue gas-conditioning systems have included systems which store liquefied sulfur which is fed to a sulfur burner in which the sulfur is converted by combustion predominantly to sulfur dioxide. The systems then pass the sulfur dioxide to a catalytic converter which employs a vanadium pentoxide catalyst to convert the sulfur dioxide into sulfur trioxide. The sulfur trioxide created by such systems is piped to a nozzle system for injection into ducts carrying the boiler flue gas and its entrained particulate material to reduce the electrical resistivity of the flue gas particulate matter for removal by an electrostatic precipitator.

As reported in "Sulfur Trioxide Conditioning", *Journal of the Air Pollution Control Association*, Vol. 25, No. 2, February 1975, pp. 156–158, such systems have been in commercial use since 1972.

A number of prior systems have been disclosed to control such $SO_3$ flue gas-conditioning systems. Such a system is disclosed, for example, in U.S. Pat. No. 3,993,429. In the system of U.S. Pat. No. 3,993,429 and in commercial systems resulting from this patent, a flow of heated air is forced into the sulfur burner; the temperature of the gas leaving the sulfur burner is sensed; and the sensed output temperature of the sulfur burner is used to control either the temperature of a flow of air forced into the sulfur burner, or the portion of a flow of heated air that is forced into the sulfur burner. The system of U.S. Pat. No. 3,993,429 increases or decreases the temperature of the air directed into the sulfur burner, or the portion of the heated air directed into the sulfur burner, in the event the burner outlet temperature is too low or too high, respectively. The system of U.S. Pat. No. 3,993,429 thus attempts to regulate the operating temperature of the sulfur burner and the catalytic converter downstream of the sulfur burner by regulating an air heater or an air flow diverter valve, or both, upstream of the sulfur burner. U.S. Pat. No. 3,993,429 also discloses a system in which the temperature of operation of the catalytic converter is controlled by providing a second flow of air to be mixed with the output of the sulfur burner, detecting the temperature of the mixture of the second flow of air and the gases leaving the sulfur burner and varying the temperature of the air in the second flow of air to maintain a desired operating temperature for the catalytic converter. U.S. Pat. No. 3,993,429 further discloses that $SO_3$ flue gas-conditioning systems can operate by sensing the rate of coal combustion and varying the rate of flow of sulfur into a sulfur burner in response to the rate of coal combustion.

U.S. Pat. No. 4,284,417 discloses a system for regulating electric power supplied to the corona-generating electrodes of an electrostatic precipitator in response to changes in opacity of the flue gas exiting from the precipitator to control and minimize electric power consumption. In the system of U.S. Pat. No. 4,284,417, an output of an opacity transducer, which is a measure of the opacity of the flue gas, is directed to a controller for the electric power supplied to the corona-generating electrodes of the electrostatic precipitator. If the opacity of the flue gas exceeds a high opacity limit set in the controller, the controller increases the power to the corona-generating electrodes; and if the opacity of the flue gas is less than the low opacity limit, the controller decreases the power to the corona-generating electrodes.

U.S. Pat. No. 4,624,685 discloses a system for optimizing the power consumption of an electrostatic precipitator. The system of U.S. Pat. No. 4,624,685 includes a controller for the transformer-rectifier sets of the electrostatic precipitator that determines the corona power required to reduce flue gas particulate matter below the environmental limit from a load indexed transducer, data input to the system and stored data and algorithms. The precipitator power is then reduced or trimmed in response to an average measured opacity of the flue gas to provide minimal precipitation power consumption consistent with meeting the environmental limit.

U.S. Pat. No. 4,770,674 discloses a system for conditioning flue gas for an electrostatic precipitator, including equipment for converting sulfur into sulfur trioxide. The disclosed systems of U.S. Pat. No. 4,770,674 include a sulfur burner to produce oxidized sulfur, a catalytic converter to convert the oxidized sulfur to sulfur trioxide, and means to control sulfur and air inputs to the sulfur burner. Various inputs to the control means are disclosed, including the outlet temperature of the catalytic converter and such operating parameters of the exhaust stage of the system as the output temperature of the exhaust gas from the precipitator, the flow rate of the exhaust gas, the power delivered to or the speed of, an induced draft fan, if any, the opacity of the exhaust gas within the stack, and the power dissipated by the precipitator.

U.S. Pat. No. 4,779,207 discloses a system for preconditioning flue gas for electrostatic precipitation. The system of U.S. Pat. No. 4,779,207 includes a source of an $SO_3$ conditioning agent, a means for controllably adding the conditioning agent to the flue gas, a means for detecting the input power level of the electrostatic precipitators and control means for monitoring the input power level and controlling the amount of conditioning agent added to the gas to substantially maintain input power to the electrostatic precipitator to predetermined levels.

Other conditioning systems are shown, for example, in U.S. Pat. Nos. 3,686,825; 4,042,348; 4,333,746; 4,466,815 and 4,533,364.

DISCLOSURE OF INVENTION

This invention provides direct, automatic control of the opacity of the effluent of a coal-fired boiler to maintain minimal opacity of the flue gas effluent passing from the boiler into the atmosphere. Systems of the invention provide a controlled flow of an agent, such as sulfur trioxide, to the boiler flue gas to condition its particulate matter for removal by electrostatic means, monitor the opacity of the boiler flue gas after it leaves the electrostatic particle-removal means and vary the controlled flow of conditioning agent to hunt and operate at conditioning agent flow rates corresponding to minimal opacities of the stack effluent. Preferred systems of the invention comprise a source of sulfur trioxide as the source of conditioning agent and the sulfur trioxide is preferably generated by the combustion of sulfur and the conversion of the products of sulfur combustion to sulfur trioxide. Preferred systems of the invention prevent incomplete, inefficient combustion of sulfur and inefficient conversion of the products of sulfur combustion into sulfur trioxide and do not react to spurious and transient effects of operation of the boiler or electrostatic particle-removing means.

In a preferred method of this invention, a flow of sulfur is provided at a controlled rate to a sulfur burner for combustion; and the products of combustion are directed to a catalytic converter for conversion to a gas stream containing sulfur trioxide. The boiler flue gas and particulate matter to be conditioned are mixed with the system gas stream containing sulfur trioxide and directed through electrostatic means for removal of the particulate matter to provide a cleaner stack effluent. In this preferred method, the opacity of the stack effluent is periodically sampled; and the rate of flow of sulfur is periodically determined. The system stores data on the opacity and rate of sulfur flow and continually increases the rate of sulfur flow in response to stack effluent opacity determinations until the opacity of the stack effluent increases or fails to decrease. In the event that the opacity of the stack effluent increases or fails to decrease, the rate of sulfur flow is reduced to a more favorable rate and preferably to the rate of flow at a prior sampling, to provide a preferred operating sulfur flow rate. In addition, the power used by the electrostatic particle removal means can also be periodically sampled, and the rate of sulfur flow can be increased from its operating sulfur flow rate if the opacity of the stack effluent increases and the power used by the electrostatic removal means decreases, and can be decreased from its operating sulfur flow if the power used by the electrostatic particle removal means increases during a plurality of sampling periods and the opacity of the stack effluent remains unchanged.

In addition, in another preferred method of this invention, the opacity of the stack effluent can be rapidly sampled between the aforesaid corrective sampling periods to determine the rate of change of opacity of stack effluent during each period between such periodic samplings and to generate a transient condition signal in the event the rate of change of opacity exceeds a predetermined or calculated rate. The transient condition signal can be used to maintain the existing sulfur flow rate during one or more subsequent periodic sampling periods.

Furthermore, once the controller has decreased the rate of sulfur flow, it can continue to decrease the rate of sulfur flow at periodic sampling times following the first such decrease until the opacity of the stack effluent increases, whereupon the system resumes increasing the rate of sulfur flow in response to stack opacity, as set forth above, to operate at the minimal opacity of stack effluent.

In the preferred methods, the temperature of the gas stream containing sulfur trioxide can be sensed at the output of the catalytic converter and prior to its mixture with the boiler flue gas; and the system can operate to prevent a flow of sulfur to the sulfur burner if the system is not at satisfactory operating temperatures, thus permitting the system to reach operating temperature before an attempt is made to generate sulfur trioxide and preventing the inefficient and ineffective conversion of sulfur into sulfur trioxide during operation.

The system of the invention comprises a source of conditioning agent, preferably sulfur trioxide, deliverable at a controlled rate, means for conditioning the particulate matter of a boiler flue gas with the conditioning agent, an electrostatic means for removal of the particulate matter from the boiler flue gas and means to measure the opacity of the resulting stack effluent. In the invention, a controller includes means for storing data on the operation of the system and means for operating the source of conditioning agent to obtain minimal opacity of the stack effluent. The controller is connected with the means to measure the opacity of the stack effluent and periodically samples the measurement of opacity of the stack of effluent for corrective action, preferably at intervals of several minutes; and the controller measures, determines, or calculates the corresponding rate of flow of conditioning agent. The controller stores the measured opacity and the corresponding conditioning agent flow rate data of such periodic measurements and increases the rate at which conditioning agent is provided until it determines the opacity of the stack effluent is increasing or no longer decreasing in response to increases in conditioning agent flow rate and, upon such a determination, reduces the conditioning agent flow rate, preferably to a more favorable prior rate of flow. The controller can also continue the reduction of conditioning agent flow rate until it measures an increase in the opacity of the stack effluent at which time it resumes increasing the rate of flow of conditioning agent to the means for conditioning boiler flue gas particulate matter, as set forth above. The extent to which the rate of conditioning agent flow is increased or decreased in operation of the controller may be by a fixed increase or decrease in the rate of flow, or the rate of conditioning agent flow may be increased or decreased in accordance with an algorithm developed to provide a more rapid approach to minimal operating opacity of the stack effluent. The system is thus capable of maintaining a minimal stack opacity and corresponding optimal particulate removal rates, during operation of the system.

The controller of such a system can also be provided with an input that is proportional to the power used by the electrostatic particle-removal means during operation of the system. Such an input can be combined with the opacity signal input, as indicated above, to determine if the sulfur flow rate should be increased or decreased and to distinguish spurious conditions that should be ignored. The controller can also provide means to sample opacity measurements rapidly between the samplings for corrective action, to determine the rate of change of opacity of stack effluent and to compare this rate of change with stored data to determine if opacity changes are the result of spurious or transient conditions that are not correctable by the system and should be ignored.

A preferred system of the invention comprises a source of sulfur trioxide as conditioning agent and, more particularly, a source of sulfur, a sulfur burner, means to deliver sulfur from the sulfur source to the sulfur burner and a catalytic converter for converting the combustion products of burned sulfur into a sulfur trioxide-containing gas stream. In such preferred systems, the controller is, preferably, connected with a sensor to detect the temperature of the sulfur trioxide containing gas stream leaving the catalytic converter and can prevent the introduction of sulfur to the sulfur burner in the event the system is either too cold or too hot. The system can thus permit the sulfur trioxide generation system to be heated to operating temperature before operation and can prevent an ineffective effort to convert sulfur to sulfur trioxide when the temperature of the system is too low or too high.

Such preferred systems of the invention can further include method and apparatus to maintain substantially constant thermal input to the sulfur burner. In such systems, a heated flow of air is provided to the sulfur burner and the heating means for the air is designed to provide sufficient heat to the air flowing into the sulfur burner to bring both the sulfur burner and the catalytic converter to satisfactory operating temperatures. The controller, or a separate controller, determines the rate at which sulfur is introduced into the sulfur burner or can be connected to a means for measuring the rate at which sulfur is being introduced into the sulfur burner.

The controller determines the heat generated by the burning sulfur in the sulfur burner and reduces, accordingly, the heat transferred to the air forced into the sulfur burner to maintain substantially constant heat dissipation in the sulfur burner.

In another preferred system of the invention, a constant flow of air is provided to the sulfur burner and the sulfur burner is heated directly by a separate heater, such as a gas burner, that is controlled by the controller or separate controller. The controller determines the rate at which sulfur is introduced into the sulfur burner or can be connected to a means for measuring the rate at which sulfur is being introduced into the sulfur burner. The controller calculates the sulfur dioxide concentration of the sulfur burner output and operates the heater for the sulfur burner to provide optimal sulfur dioxide concentrations from the sulfur burner output to the catalytic converter for conversion to sulfur trioxide. This preferred system is particularly desirable for use with a two-stage catalytic converter to provide conversion efficiencies above 90% by operating the first stage of the catalytic converter under its best operating conditions. In such systems with two-stage catalytic converters, the controller can be provided with a temperature input from between the first and second stages of the catalytic converter which can also be used to control the heater for the sulfur burner. In addition, a flow of cooling air can be introduced between the first and second stages of the catalytic converter.

The invention also provides still further improved apparatus and methods for the treatment of boiler flue gas in coal-fired electrical generating facility.

Such a further improved apparatus comprises an integrated assembly adapted to provide a flow of air and sulfur dioxide and to be shipped and installed as a unit at an electrical generating facility, and a plurality of sulfur dioxide conversion means adapted to be individually supported and operated remote from the integrated assembly at a plurality of sites where sulfur trioxide is to be injected into the boiler flue gas. In such improved apparatus, the integrated assembly comprises a first means for providing a flow of sulfur dioxide, a second means for providing a flow of heated air, a third means for mixing the flows of sulfur dioxide and heated air to produce a combined flow of sulfur dioxide and air at a temperature in excess of the condensation temperature of sulfurous acid, and a fourth means for supporting and carrying the first, second and third means. The integrated assembly may also include a means for dividing the flow of sulfur dioxide and air into a plurality of flows for direction to the plurality of sulfur dioxide conversion units. Each of the plurality of sulfur dioxide conversion units includes a heater and catalytic converter of substantially reduced size, having a heating and conversion capacity limited to that needed at a single injection site.

In a preferred integrated assembly, the first means generates sulfur dioxide from liquefied sulfur by pumping the liquefied sulfur to a sulfur burner. An air blower provides a first flow of air to the sulfur burner and a second flow of air for combination with the sulfur dioxide generated in the sulfur burner, and the first and second flows of air from the air blower are heated with first and second heaters. Such a sulfur burning first means can provide heating energy to the sulfur burner for its conversion of sulfur to sulfur dioxide, and a substantially greater air flow can bypass the sulfur burner and can be used to dilute the sulfur dioxide output of the sulfur burner to a proper concentration for delivery to and $SO_3$ conversion at the plurality of sulfur dioxide conversion unit.

The invention thus provides a non-complex, direct apparatus for maintaining effectively minimal opacity of the stack effluent of a coal-fired boiler by its novel method and apparatus for control of a source of a conditioning agent, such as a sulfur trioxide generation system. The system of the invention can also bring such a preferred $SO_3$-generation system to satisfactory operating temperature, maintain satisfactory operating temperatures and protect the system against operation in the event the temperature of the sulfur burner or catalytic converter becomes too high or too low. Systems and apparatus of the invention are less expensive and more effective and reliably shipped, installed and used than prior systems.

Other features and advantages of the invention will become apparent from the drawings and detailed description which follow.

BEST MODE FOR CARRYING OUT THE INVENTION

Figure 1:
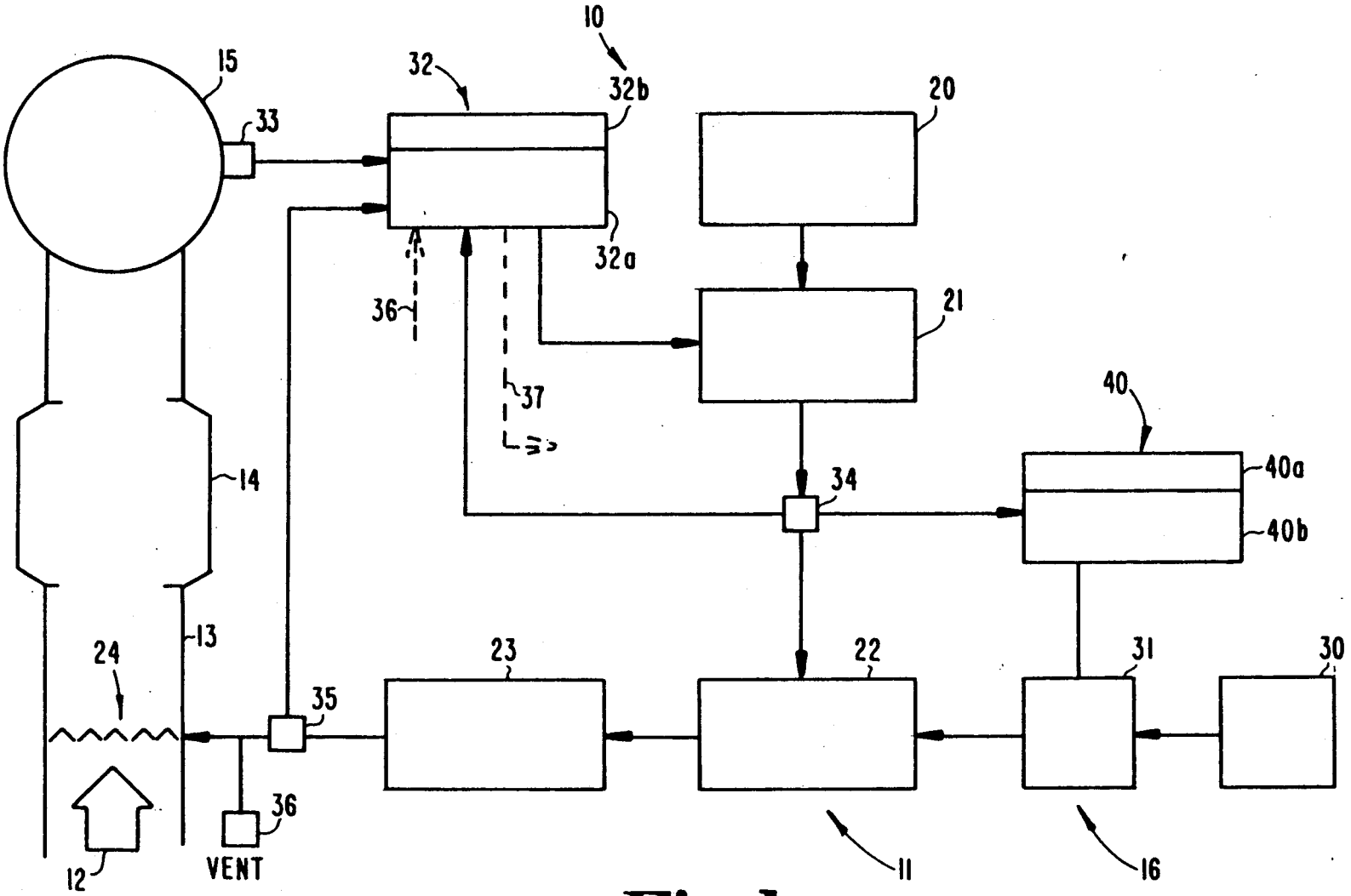
FIG. 1 is a diagrammatic drawing of a preferred system of the invention.

A system 10 incorporating the invention is shown in FIG. 1. To clarify the presentation of the invention, venting valves and lines, heating and temperature controlling means for the sulfur source, shut-off valves and temperature pressure and level gauges have been omitted from FIG. 1 and the other drawings; but one skilled in the art will recognize that the systems of this invention can include such valves, gauges and venting means as are necessary to the convenient operation, control and maintenance of the system.

System 10 includes generally a source of conditioning agent, preferably a means 11 for providing a flow of sulfur trioxide to a flow of particulate-laden boiler flue gas, indicated generally by arrow 12, within a duct or conduit 13 upstream of an electrostatic means 14 for removing particulate matter from the boiler flue gas prior to its expulsion to atmosphere from a stack 15. Such a sulfur trioxide source 11 is preferably designed to provide sulfur trioxide sufficient to condition the particulate matter of a boiler flue gas ranging from 3 $g/m^3$ stp to about 10 $g/m^3$ stp and to provide an $SO_3$ concentration of preferably 20 to 30 ppm and generally less than 40 ppm. As set forth below, the source of conditioning agent is controlled by a controller 32 to provide conditioning agent at controlled rates to obtain and maintain minimal opacities of the stack effluent.

The preferable source of conditioning agent shown in FIG. 1 comprises means 11 for producing a flow of sulfur trioxide, including a sulfur source 20, a means 21 for delivering a flow of sulfur from source 20 to a sulfur burner 22 and a catalytic converter 23 to convert the products of combustion of sulfur from sulfur burner 22 into sulfur trioxide. In FIG. 1, the sulfur trioxide from catalytic converter 23 is directed to a boiler flue gas-conditioning means 24 for introducing sulfur trioxide into the boiler flue gas and its entrained particulate matter upstream of electrostatic precipitator 14. Means 24 may include a plurality of nozzles or injectors for introducing sulfur trioxide into the flowing boiler flue gas and baffles or other means upstream and/or downstream of the plurality of nozzles to achieve exposure of the particulate matter carried by the boiler flue gas to the sulfur trioxide so that the sulfur trioxide effectively conditions the particulate matter for removal by electrostatic precipitator 14.

Sulfur source 20 can be either an insulated, steam-heated, steel container or a concrete-lined storage pit placed largely underground and is preferably adapted to contain liquefied sulfur. The tank or concrete pit can contain a heater or heat exchanger in intimate contact with the sulfur to liquefy the sulfur and to keep the liquefied sulfur at the preferred temperature for minimum viscosity and pumping. The heat exchanger within sulfur source 20 may be any heat exchanger suitable for this purpose and may be provided with any source or heat, such as steam or the output of a suitable oil or gas burner.

Means 21 to deliver sulfur from source 20 to sulfur burner 22 is preferably a positive-displacement pump, such as a gear pump or vane pump, driven by a variable speed electric motor to deliver a flow of liquefied sulfur at a controllable rate. In preferable systems, the positive displacement pump may be immersed within the liquefied sulfur to simplify the installation, improve operating characteristics and eliminate pump seal problems. Where, as in preferred systems of this invention, the source of sulfur includes a steel tank or a concrete pit buried in the ground, the variable speed electric motor and its control for means 21 can be placed in a protected enclosure mounted on the tank or on a support that covers the pit and provides thermal insulation between the exterior atmosphere and the liquefied sulfur within the pit. The variable speed electric drive for the vane pump or gear pumps that pump sulfur at a controlled rate may be any commercially available variable speed electric motor drive with sufficient power output to provide a flow of sulfur at rates of, for example, one to five lb./min. (0.45–2.26 kg./min.) and a pressure of 60–100 psi (4218–7030 $gm/cm^2$). Since liquefied sulfur is easy to pump, e.g., having a viscosity on the order of water and being non-abrasive, it will be apparent to those skilled in the art that a number of commercially available positive-displacement pumps may be used in means 21.

Sulfur burner 22 and catalytic converter 23 are the type known to those skilled in the art. The sulfur burner is the type frequently referred to as a "checker work" or a "cascade burner" operable preferably in the range of 800° F. to 850° F. (427° C. to 454° C.) to oxidize the liquefied sulfur into sulfur dioxide through combustion. The catalytic converter is likewise a structure and converter well-known in the art which is capable of catalytically converting sulfur dioxide to sulfur trioxide through the action of a vanadium pentoxide catalyst. The converter contains vanadium pentoxide generally applied to the surface of ceramic elements; and as sulfur dioxide passes through the catalytic converter, it is exposed to the catalyst and is converted into sulfur trioxide. It is well known in the art that such catalytic converters preferably operate at a temperature range from about 750° F. to about 1075° F. (399° C. to 579° C.) and, preferably, at about 850° F. (454° C.). It is also well known in the art that below temperatures of about 750° F. (399° C.) and above temperatures of about 1100° F. (593° C.) such catalytic converters are not efficient in converting sulfur dioxide into sulfur trioxide.

As shown in FIG. 1, the system also includes a means 16 for providing a heated flow of air to means 11 for providing a flow of sulfur trioxide. Means 16 for providing a heated flow of air includes a means 30 to provide a flow of air to sulfur burner 22 and a means 31 to heat the air from air flow means 30 prior to its entry into sulfur burner 22. Air flow means 30 may be a commercial air blower of a type known to those skilled in the art. The size of the blower and its electric motor drive will depend upon the capacity of sulfur trioxide source 11. The air flow from blower 30 is directed through heater 31 and from heater 31 through sulfur burner 22 and catalytic converter 23 and is then directed into duct 13 for the boiler flue gas. Air flow means 30 and air heater means 31 comprise in combination means 16 to heat sulfur trioxide source 11; particularly, means 30 and 31 comprise collectively a controllable means to heat sulfur burner 22 and catalytic converter 23 to satisfactory operating temperatures and, preferably, their preferred operating temperatures. Accordingly, the blower of means 30 and the heater of means 31 are designed to provide a flow of air through sulfur burner 22 to catalytic converter 23 at temperatures in excess of about 750° F. (399° C.) and, preferably, on the order of 800° F. to about 850° F. (427° C. to 454° C.). Means 16, comprising air flow means 30 and air flow-heating means 31, may be operated to bring sulfur trioxide source 11 to its preferred operating temperatures within reasonable times and to maintain sulfur trioxide source 11 at its preferred operating temperatures during standby periods.

In accordance with the invention, the system of FIG. 1 is provided with means 32 comprising, preferably, a data processor, such as a microprocessor **32*a* and a data storage means 32*b*, such as a non-volatile RAM storage device, that operate to provide a controller for maintaining minimal opacity of the stack effluent of the system through conditioning of the particle-laden boiler flue gas. Controller means 32 controls means 21 for providing sulfur at a controlled rate to sulfur burner 22. Controller 32 is connected with an opacity meter 33 that provides output signals proportional to the opacity of the effluent from stack 15** and can be adapted to measure, calculate, or otherwise determine the rate of flow of a conditioning agent. In the preferred system of FIG. 1, controller 32 can determine or calculate the rate of sulfur flow from the known operation of the preferred positive displacement pumps of means 21, or controller 32 may be connected with a flow meter 34, as shown in FIG. 1, that provides a signal proportional to the rate at which sulfur is being provided to sulfur burner 22 by sulfur pump means 21. Finally, controller 32 is connected with a temperature sensor 35 that either provides controller 32 with a signal proportional to the temperature of the gas leaving catalytic converter 23 or provides controller 32 with a signal indicating that the gas flowing from catalytic converter 23 is outside the satisfactory operating temperature range of the catalytic converter. Preferably, temperature sensor 35 is adapted to provide controller 32 with a signal indicating the output of the catalytic converter is less than about 725° F. (385° C.) or greater than about 1200° F. (649° C.) or with a signal proportional to the temperature of the output of catalytic converter 23 that permits controller 32 to determine if the output of catalytic converter 23 is less than 725° F. (385° C.) or more than 1200° F. (649° C.).

Controller 32 is programmed to periodically sample the signal from opacity meter 33 and store the measurements of opacity of the stack effluent and the corresponding rates of sulfur flow as determined by mass flow meter 34. Controller 32 samples stack effluent opacity and determines the corresponding rate of sulfur flow every few minutes for corrective action. The corrective sampling period or interval t may be varied to suit the system of the electric utility.

Figure 2A:
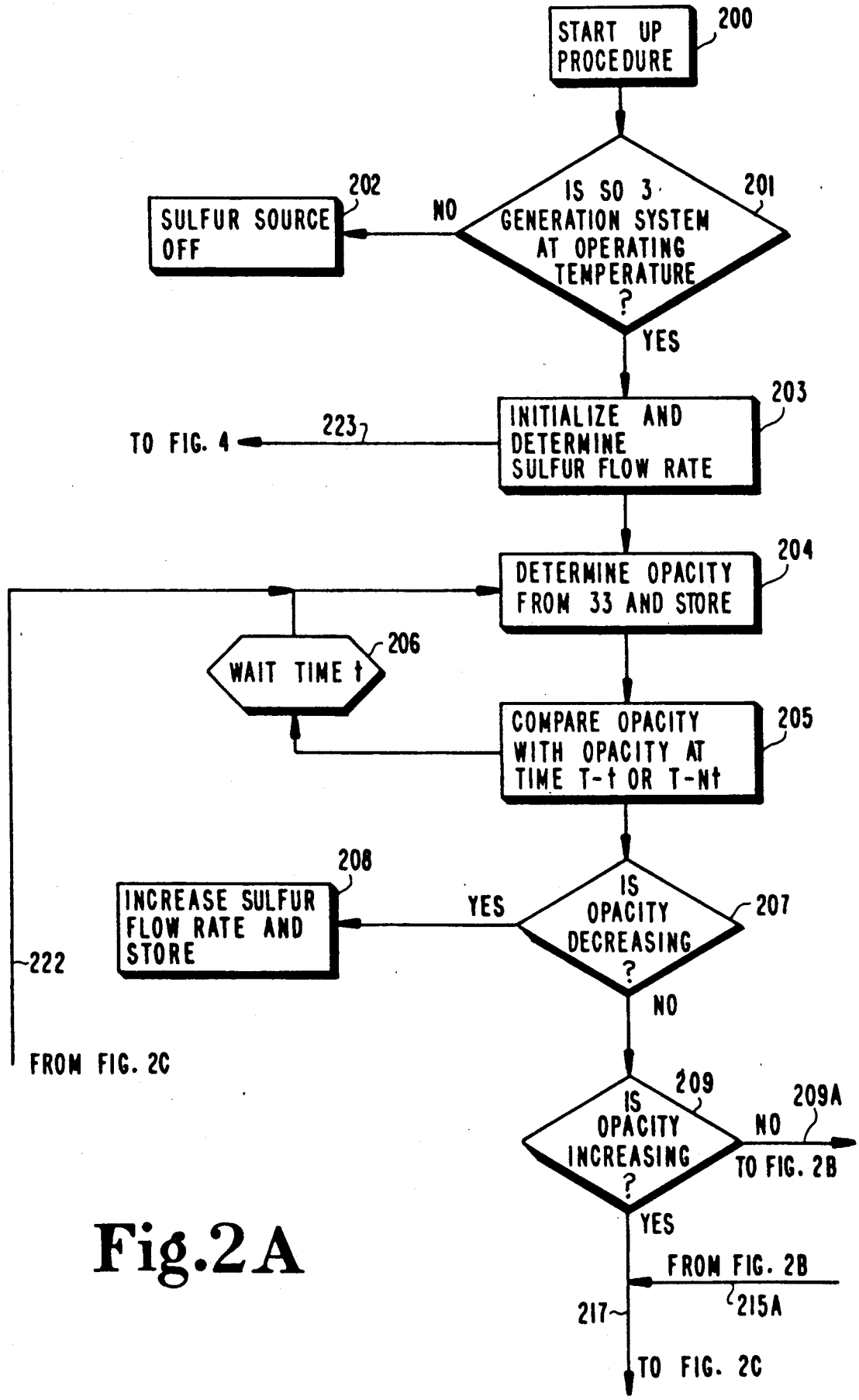
FIGS. 2A, 2B and 2C are a flow chart of one of the programs by which a controller of the invention operates.
Figure 2B:
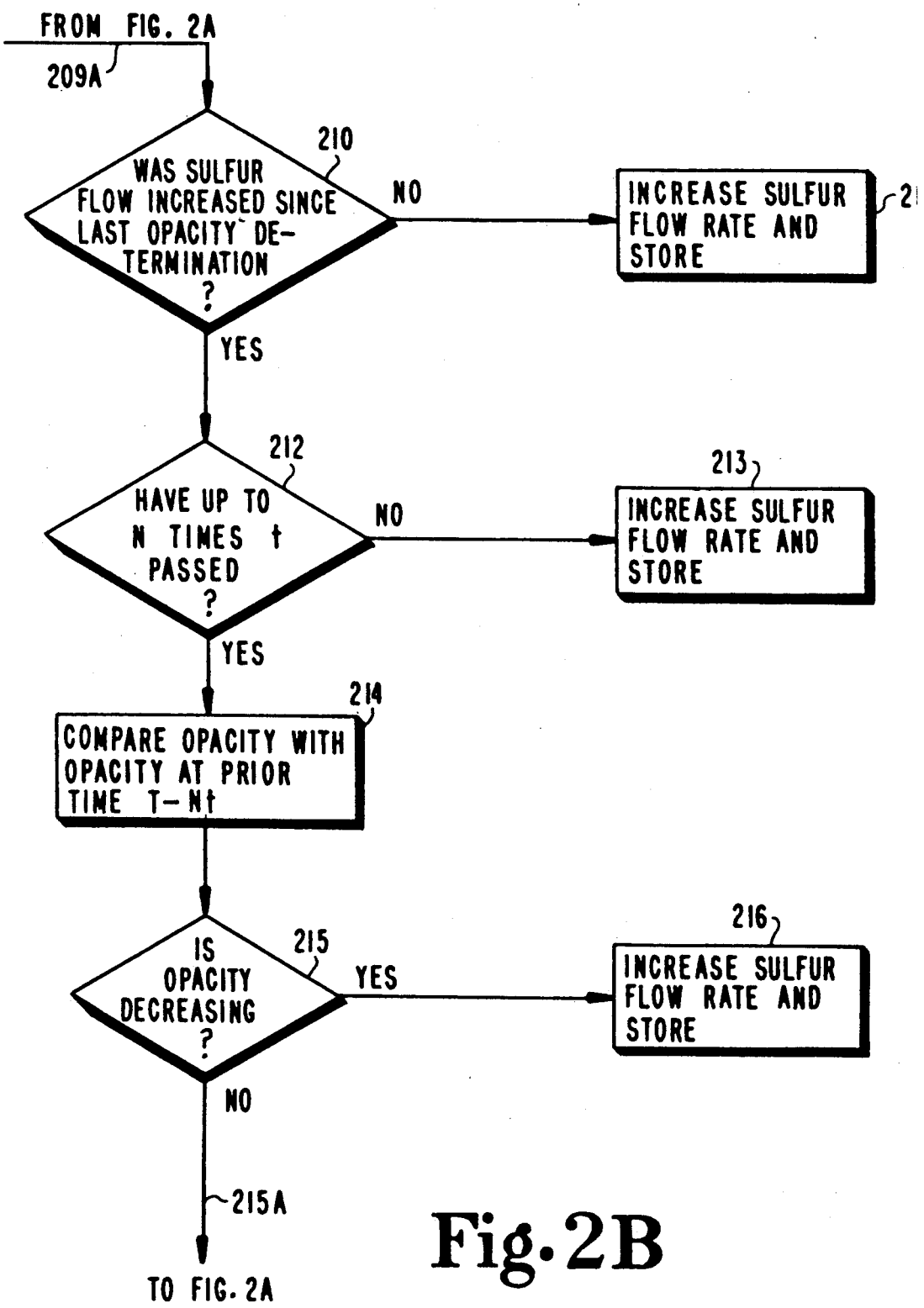
Figure 2C:
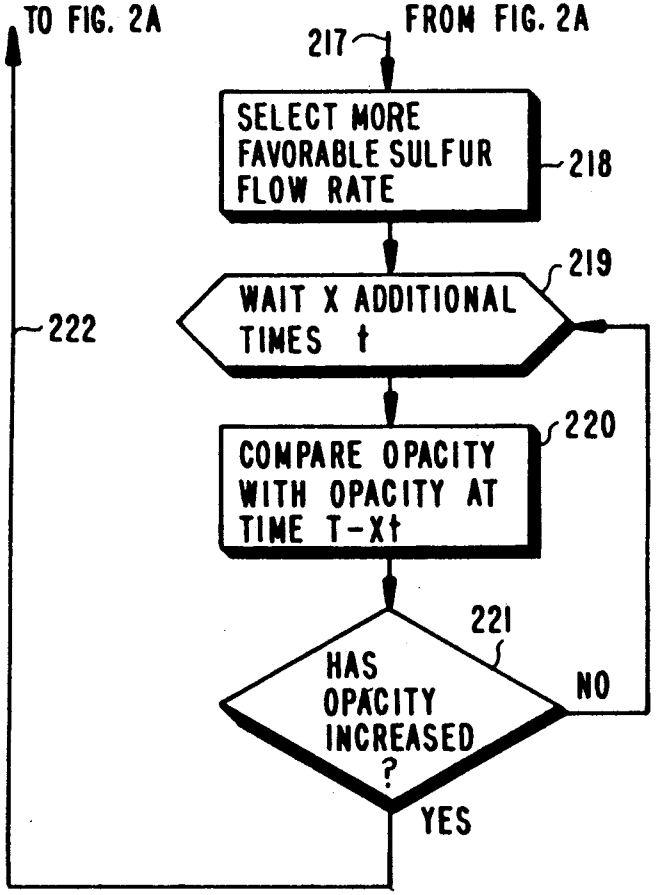

A flow chart of the program for controller 32 is set forth on FIGS. 2A, 2B and 2C, with FIGS. 2A and 2B being interconnected at the lines numbered 217 and 222. The program includes a start-up procedure 200 that may be varied, depending upon the system with which it is used. The program also preferably includes a determination that the $SO_3$ generation system 11 has reached and is at a satisfactory operating temperature and, if not, prevents $SO_3$ generation (see steps 201 and 202). If the $SO_3$ generation system is at satisfactory operating temperature, controller 32 determines, as set forth below, an initial sulfur flow rate to the $SO_3$ generation system (step 203) and commences its operation to obtain minimal opacity of the stack effluent (steps 204 through 221).

Controller 32 compares the opacity of the stack effluent at each sampling period with the opacity of the stack effluent measured at one or more (n) prior periods. If the opacity of the stack effluent is less by a significant amount, which may have a variable value stored in controller 32, controller 32 provides a signal to the variable speed drive means for constant displacement pump of means 21, increasing the rate of flow of sulfur for the next period. In preferred systems of the invention, each corrective sampling period t of controller 32 is at least several minutes and, preferably, on the order of seven to ten minutes. During the following period, sulfur is provided from source 20 for burner 22 at the increased flow rate and converted to sulfur trioxide and introduced into the boiler flue gas at an increased rate by sulfur burner 22 and catalytic converter 23.

After the corrective sampling period t of several minutes, controller 32 again samples the output of opacity meter 33 and compares the measurement of opacity of the stack effluent with a prior opacity of the stack effluent, preferably the last measurement; and if the opacity of the stack effluent is again less than the opacity of the prior measurement by a significant amount, controller 32 again increases the rate of flow from sulfur source 20 to burner 22 through the action of the positive-displacement pumps of means 21 and their variable speed electric drives.

Controller 32 continues this process of increasing the rate of flow of sulfur to sulfur burner 22 until the opacity of the effluent from stack 15 increases by a significant amount, or fails to decrease, for one or more periods (steps 204–208, FIG. 2A).

If controller 32 determines that increasing the sulfur flow rate has increased or failed to decrease the opacity of the stack effluent, controller 32 can cease any further increase in the rate of sulfur flow or can return the rate of sulfur flow to a more favorable rate by decreasing the rate of sulfur flow by one or more predetermined or calculated amounts or by returning the sulfur flow rate to a rate corresponding to a prior sampling period. For example, as shown in FIG. 2C, if an increase in the rate of flow of sulfur to sulfur burner 22 results in an increase in the opacity of the stack effluent by a significant amount, which may be stored in the controller, controller 32 can retrieve from its memory the sulfur flow corresponding to the minimum opacity of the stack gas and provide a signal to the variable speed electric drive for the constant displacement pumps of means 21 to operate the pumps at the sulfur flow corresponding to minimum stack opacity. Controller 32 can thereafter immediately resume its method of increasing sulfur flow rates as set forth above or can resume such operation after a programmed waiting period x (steps 209 and 218–222).

In addition, as shown in FIG. 2B, controller 32 can be programmed so that if the change of opacity of the stack effluent remains essentially constant, that is, if the change in stack opacity does not exceed a significant stored, but programmable, amount in a programmable number of periods, controller 32 can continue to increase the rate of flow of sulfur from source 20 into sulfur burner 22 for the programmed number N of additional periods and can compare the measured opacities to confirm that opacity has remained essentially constant and then search its memory for the lowest rate of sulfur flow corresponding to the essentially constant opacity and thereafter provide a signal to drive the constant displacement pumps of means 21 at the lowest rate of sulfur flow corresponding to the essentially constant opacity of the stack effluent until the opacity meter 33 indicates an increase in opacity greater than the significant store amount, at which time controller 32 resumes the process of increasing the rate of sulfur flow as described above (steps 207, 209 and 210–222). The number of additional periods N in which controller 32 can continue to increase the rate of sulfur flow from source 20 to sulfur burner 22 may be varied by the system operator.

Generally, however, after the rate of sulfur flow to the sulfur burner has increased by 15 to 20 percent with no significant decrease in the opacity of the stack effluent, no further increases in sulfur trioxide generation will be effective; and the system should thereafter operate at the minimum sulfur flow rate corresponding to the minimal stack opacity. It should be recognized, however, that if the number of periods over which controller 32 increases sulfur flow rate under conditions of substantially constant opacity of the stack effluent is large, the system will operate with relatively large variations in the rate at which sulfur is delivered from source 20 to sulfur burner 22 with a somewhat wasteful use of sulfur; and for this reason, it is advisable that controller 32 be programmed to make its operating decision after a minimal number of periods in which it is measuring essentially constant opacity of the stack effluent.

Figure 2D:
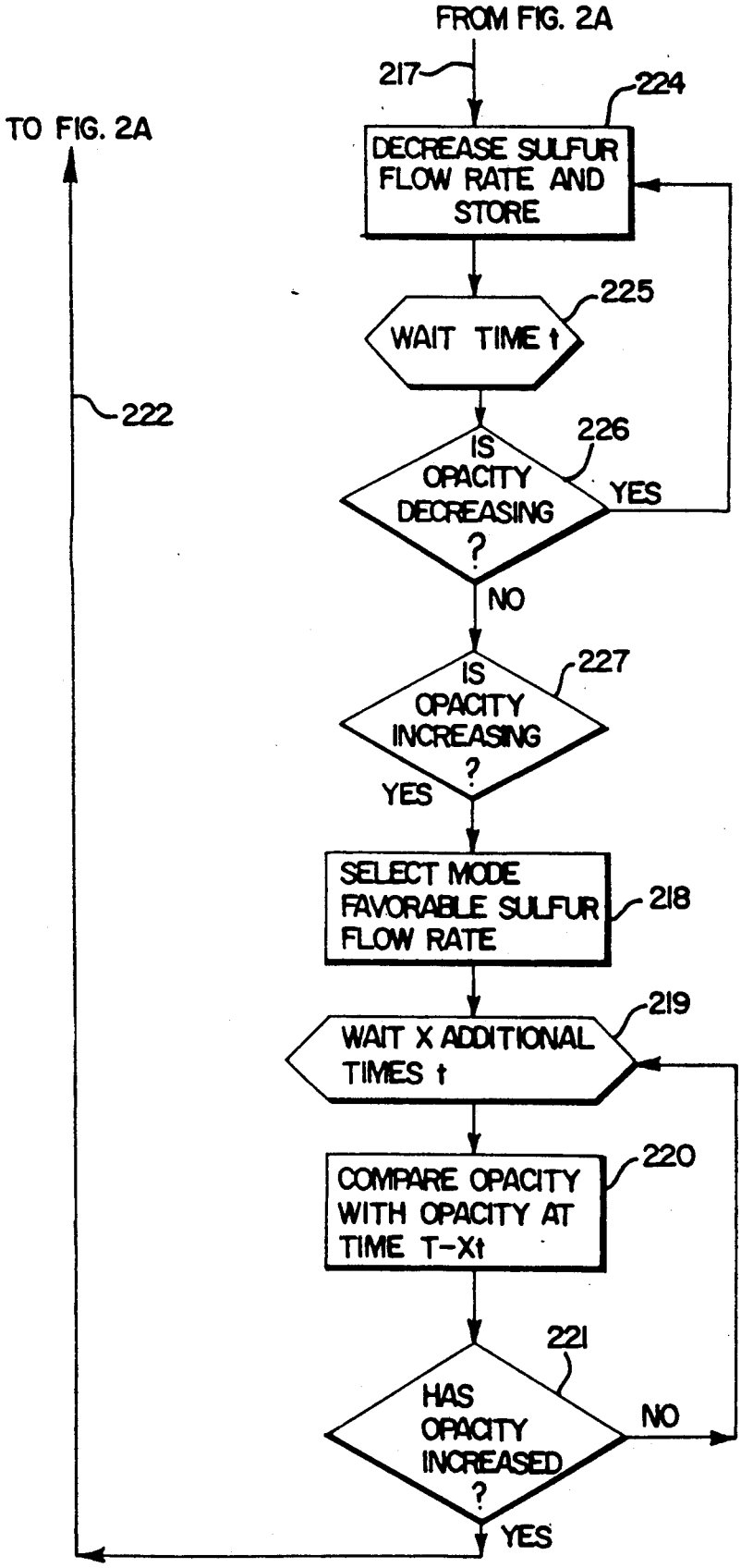
FIG. 2D is a flow chart of a modification of the program, including the program of FIGS. 2A and 2B, by which a controller of this invention can operate.

As shown in FIG. 2D, controller 32 may also be programmed so that in the event it measures increased opacity of the stack effluent after a period in which it has increased the rate of sulfur flow, it may begin decreasing the rate of sulfur flow by a preprogrammed or calculated increment of flow and continue to operate in this mode for successive corrective sampling periods until it detects an increase in opacity of the stack effluent for one or more corrective sampling periods, whereupon it selects a more favorable sulfur flow rate (steps 209 and 224–227 and 218) and thereafter reverts to operation by increasing the sulfur flow rate by a preprogrammed specified amount, as set forth above (steps 219–227). As indicated in FIG. 2D, this program can be effected by the addition of steps 224–227 between steps 209 and 218 of the program of FIGS. 2A–2C.

Thus, controller 32 may provide means to hunt the rate of sulfur flow to sulfur burner 22 that produces a minimal opacity of the effluent from stack 15 and to operate with sulfur flow rates providing minimal opacities of the stack effluent.

Controller 32 may be provided with one or more additional inputs, as shown by a dashed input or inputs 36, to help maintain an optimal opacity of the stack effluent. Such an input may be, for example, the signal output of an Elan analyzer which can provide on-line analysis of coal to be burned for its sulfur content. Such an input may also be a sulfur dioxide analyzer that samples the sulfur dioxide content of the flue gas leaving the boiler and provides an output characterizing the sulfur content of the coal being burned and the need for particulate matter conditioning agent. Further inputs may be an input from the throttle of the turbine controller to anticipate increases in the demand for conditioning agent and an input from the electrostatic precipitator to help distinguish spurious and transient operating conditions that cannot be corrected with the system. Such outputs may be converted to a format usable by controller 32 to anticipate changes in particulate matter resistivity and the need for an increased or decreased flow of conditioning agent. The output of such analyzers may be used by the controller, for example, to change the data used by controller 32, to shorten the corrective sampling period t, or change the number of sampling periods n and N, in anticipation of a change, or to reset the rate of flow of sulfur to a rate that anticipates future operation, or may otherwise be used to decrease system response times and improve system operation.

Controller 32 may also, preferably, be programmed to stop the flow of sulfur from source 20 to sulfur burner 22 in the event that the output of catalytic converter 23 is not within satisfactory temperature limits (e.g., less than 725° F. (385° C.) or more than 1200° F. (649° C.)) as shown in step 201 of FIG. 2A. As indicated above, the system preferably includes temperature sensor 35 to sense the temperature of the output of the catalytic converter. The signal from temperature sensor 35 provides controller 32 with the information it needs to determine if sulfur trioxide source 11 is at temperatures outside the ranges at which it should be operated. Controller 32 will prevent the operation of means 21 for providing sulfur to sulfur burner 22 until temperature sensor 35 indicates that sulfur burner 22 and catalytic converter 23 have reached satisfactory operating temperatures (e.g., substantially above 725° F. (385° C.)). As indicated above, sulfur burner 22 and catalytic converter 23 may be preheated by means 16 including air flow source 30 and air flow heater 31. In addition, controller 32 can stop the flow of sulfur to sulfur burner 22 by turning off means 21 to prevent a flow of sulfur to the sulfur burner in the event that the temperature sensed by temperature sensor 35 indicates that sulfur burner 22 and catalytic converter 23 are too hot (e.g., in excess of 1200° F. (649° C.)) or too cold (below 725° F. (385° C.)) (steps 201 and 202). Temperatures in excess of 1200° F. (649° C.) at temperature sensor 35 indicate that the temperature of the catalytic converter is outside of its effective operating range.

While I have indicated that temperature sensor 35 and controller 32 should preferably operate to be sensitive to temperatures under 725° F. (385° C.) and over 1200° F. (649° C.), the range of temperatures to which temperature-sensing means 35 should be sensitive may be a narrower range. For example, the minimum temperature at which the system should be operated as sensed by temperature sensor 35 may be 750° F. (399° C.); and the maximum temperature at which the system should be operated as sensed by temperature sensor 35 may be 1100° F. (593° C.).

Controller 32 comprises preferably an Allen-Bradley T30 Plant Floor Terminal Programmable Controller or a Bristol-Babcock Network 3000 Compatible Intelligent Controller, but other equivalent programmable controllers can be used. Controller 32 can be provided by a programmable microprocessor and random access memory.

The system of the invention also includes means for maintaining substantially constant heat dissipation within sulfur burner 22. To clarify the description of the system, FIG. 1 illustrates, as separate, a further controller 40 for means 16 to provide a flow of heated air to sulfur trioxide-generating means 11. Controller 40 is, in a preferred embodiment of the system, part of the Allen-Bradley T30 Plant Floor Terminal Programmable Controller, which can perform the function of controller 32 and the function of controller 40 described below. Controller 40 is connected with means 34 to measure the rate at which sulfur is flowing into sulfur burner 22. Since burning sulfur liberates about 4,000 btu's per pound of sulfur burned, controller 40 may be programmed to compute the thermal input to sulfur burner 22 from the sulfur being combusted therein. The rate of heat flow to sulfur burner 22 from the burning sulfur is generally computed by multiplying rate of sulfur flow (Q) to the sulfur burner by the amount of heat (S) generated by the burning sulfur (approximately 4,000 btu's per pound of sulfur). This quantity may be used to reduce the power or heat provided by air flow heater 31 of means 16 to maintain a substantially constant heat dissipation within sulfur burner 22. Controller 40, sulfur burner 22 and means 16 are designed so that, under normal operation, the substantially constant heat input to sulfur burner 22 maintains the temperature within sulfur burner 22 in excess of 750° F. (399° C.) and, preferably, about between 800° F. (427° C.) and 850° F. (454° C.).

Figure 4:
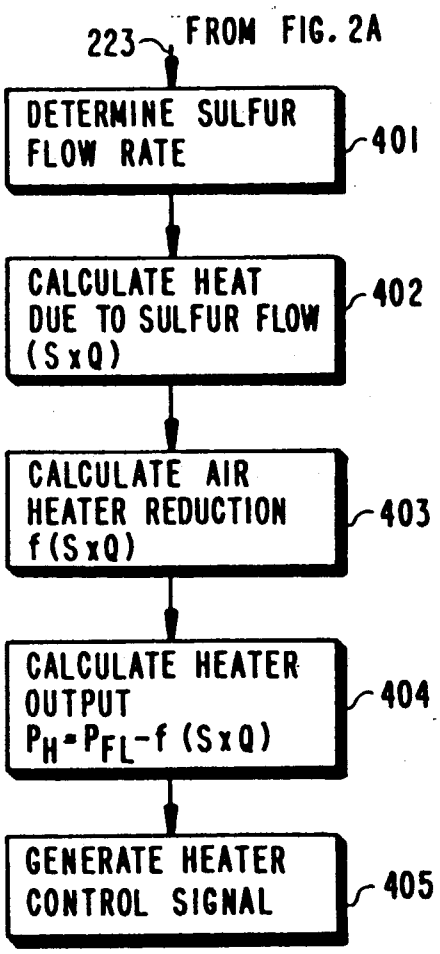
FIG. 4 is a flow chart of another program by which a controller of the invention can operate.

Controller 40 may be a separate controller selected from among many commercially available programmable controllers or microprocessors as apparent to those skilled in the art, but, preferably, is part of the Allen-Bradley or Bristol Babcock controllers identified above, programmed as set forth in FIG. 4.

Figure 3:
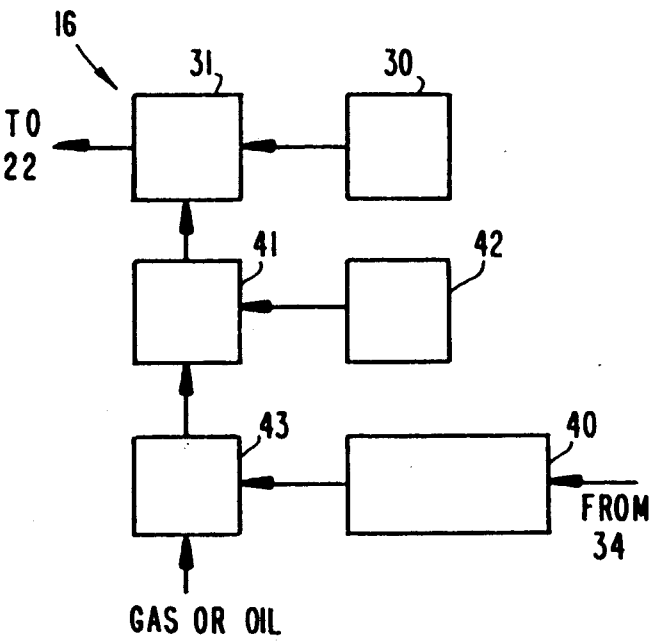
FIG. 3 is a diagrammatic drawing of another embodiment of the means for providing heat to the sulfur trioxide-generating source of the preferred system of FIG. 1.

Heater 31 for the air flow into the sulfur burner may be an electrical heater in which air flow from blower 30 is directed over one or more electrical resistance heating units to bring the output temperature to temperatures of about 900° F. (482° C.). In the alternative, as shown in FIG. 3, air flow-heating means 31 of means 16 for providing a flow of heated air to the sulfur burner may be a heat exchanger 31 in which hot gas from a fuel oil or gas burner 41 is directed through heat exchange coils over which the air from blower 30 is directed to raise the air flowing outwardly from heater 31 to temperatures in excess of 900° F. (482° C.). The coils of the heat exchanger may be connected with the output of fuel oil or gas burner 41 which is provided with a burner blower 42 in a manner known in the art and the expended output of the burner may be vented to atmosphere from the heater coils. Such a fuel oil or gas heater system may be preferable in many installations where electrical power may not be conveniently provided for heater 31. Where heater 31 is powered by a gas or fuel oil burner 41, controller 40 controls the flow of fuel oil or gas to burner 41 through a variable flow control valve 43 in accordance with a stored algorithm to provide a constant thermal input to sulfur burner 22.

Controller 40 is thus programmed to receive a signal from mass flow meter 34 and to calculate from the signal from flow meter 34 the rate Q at which sulfur is being directed to sulfur burner 22. Controller 40 can calculate from an algorithm or a data table stored in controller 40 a power reduction for the electrical resistance-heating means within heater 34 in the event electrical heat is used, or controller 40 can calculate a setting for variable flow control valve 43 used to control the fuel oil or gas to a burner 41 from a source of fuel oil or gas in the event that a gas- or fuel-oil-fired heat exchanger is used as heating means 31. Controller 40 thus controls means 16 for providing a heated flow of air to the sulfur burner by the equation:

$$P_H = P_{FL} - f(Q \times S)$$

where $P_H$ is the heat provided by air-heating means 31;

$P_{FL}$ is the full-load output of the air-heating means 31;

Q is the sulfur flow rate into sulfur burner 22;

S is the thermal output of the sulfur fuel provided to sulfur burner 22; and f is a function of $(Q \times S)$ that determines the operation of means 16, particularly the heaters of air-heating means 31 or control valve 43. A flow chart for the program of controller 40 is set forth in FIG. 4.

The system of this invention operates from the recognition that the opacity of the stack effluent may not be effectively controlled by variation of the power to the electrostatic precipitator or by an effort to correlate conditioning agent supply to the rate of coal consumption and from recognition that there is generally a rate of conditioning agent supply that corresponds to minimal opacity of the effluent from an electrostatic precipitator because, among other things, the conditioning of the particulate matter of a boiler flue gas can lower the bulk resistivity of the particulate matter to the point where the collected conductive particulate matter within an electrical precipitator can interfere with the removal of particulate matter by the electrostatic precipitator. It has been reported, for example, that when the resistivity of the particulate matter on the collection plate of an electrostatic precipitator is too high, the collected particulate matter can act like an insulator and permit the development of collected surface charges that reduce electrostatic field gradients and charging currents of the electrostatic precipitator and reduce its collecting efficiency. On the other hand, when the resistivity of the particulate matter is too low, the collected particulate matter loses its charge quickly, preventing the retention of the particulate matter on the precipitation plates and allowing reentrainment of the particulate matter, thus reducing the collecting efficiency of the electrostatic precipitator. The system of this invention is based on the recognition that maximum precipitator power levels usually do not correspond to minimum opacity levels. Too high a rate of generation of conditioning agent for particulate matter often produces a particulate matter resistivity which is too low, causing fly ash reentrainment, an increase in stack opacity and/or a brown/blue sulfur plume. It is believed that the system of this invention provides optimal removal of particulate matter that is attainable by control of conditioning agent production and use.

Figure 5C:
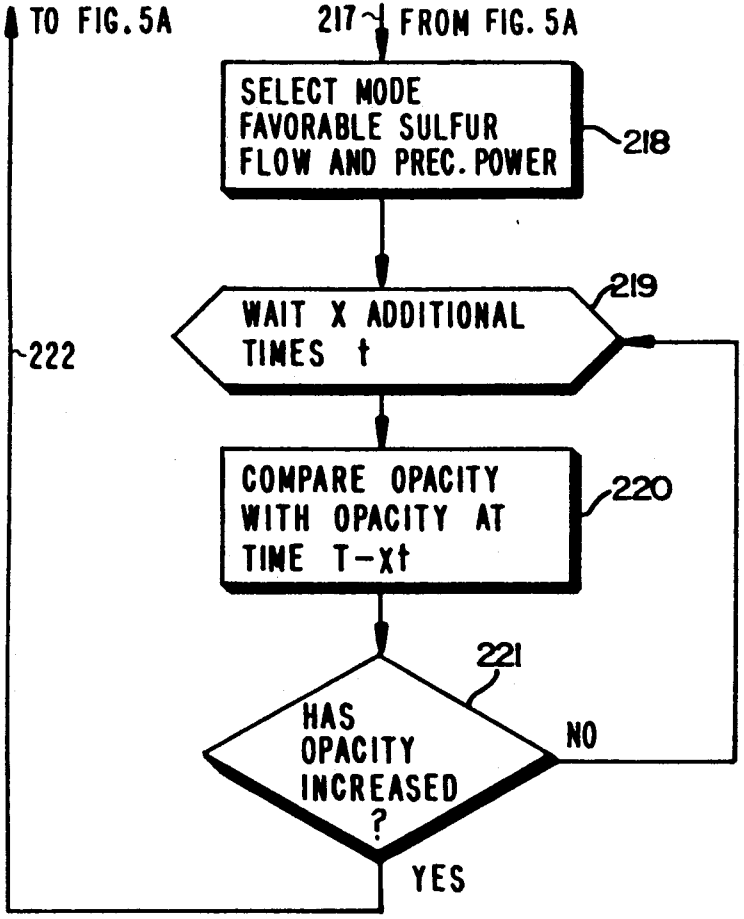
FIGS. 5A, 5B and 5C are a flow chart of another program by which a controller of the invention can operate.
Figure 5A:
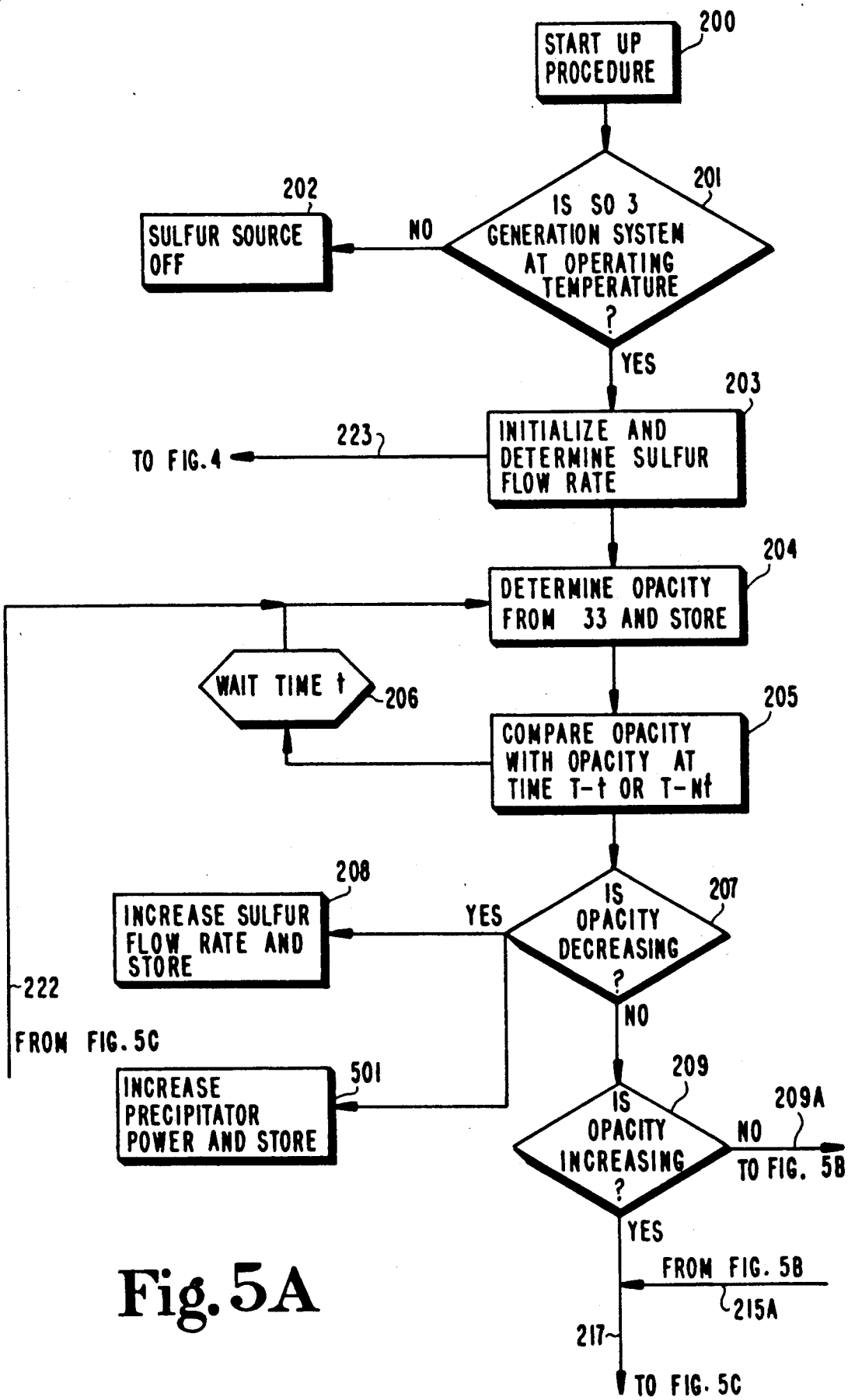
Figure 5B:
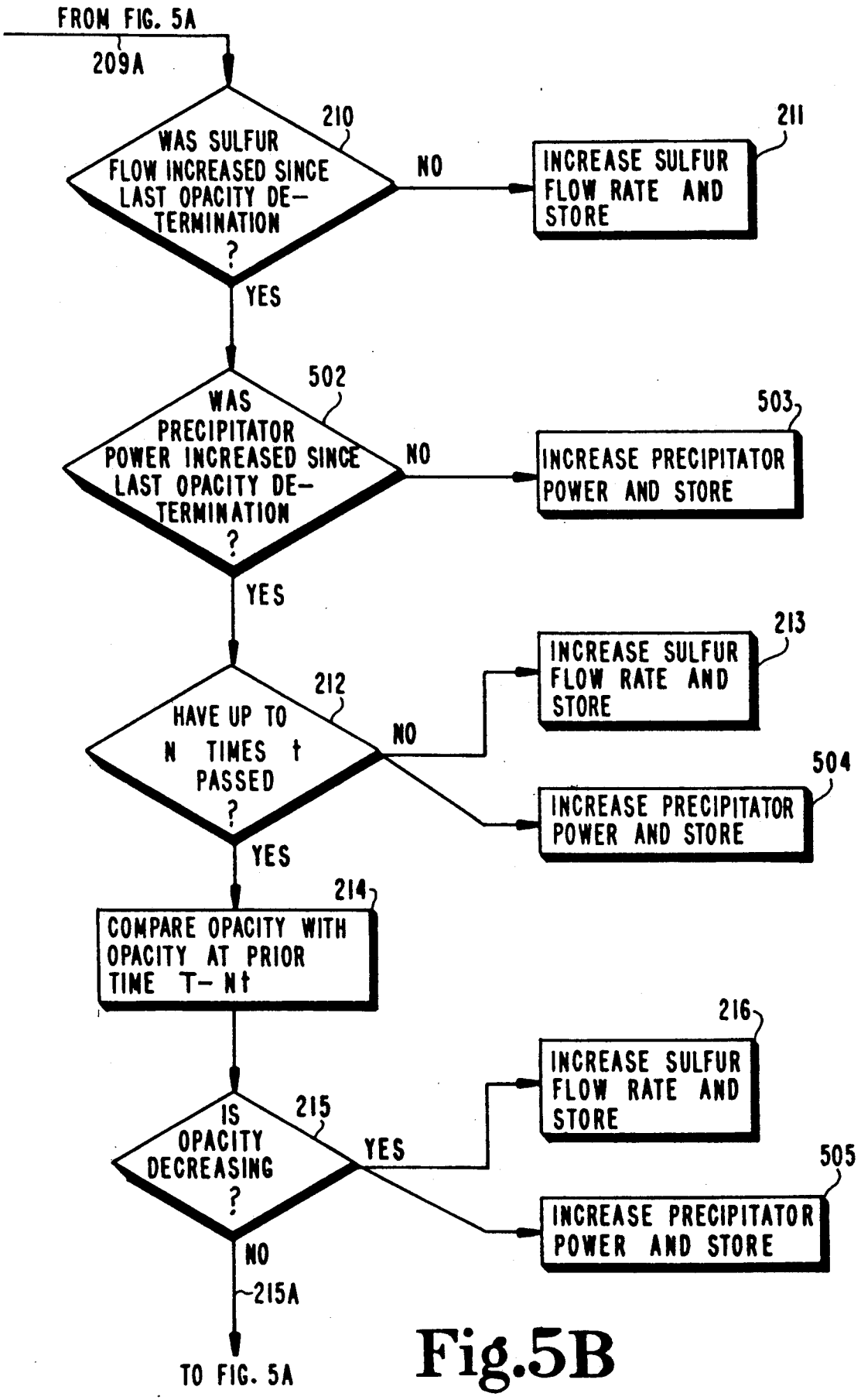

Controller 32 can also control, through the use of the program shown in FIGS. 5A, 5B and 5C and one or more additional outputs 37, the electrical power to the electrostatic particle-removal means to operate it at voltage and/or current levels that correspond to minimal opacities of the stack effluent. To so operate, one or more of inputs 36 of controller 32 can provide controller 32 with a signal or signals indicating the operating conditions of the electrostatic precipitator at each corrective sampling period; and controller 32 can be programmed to increase the voltage and/or current of the electrostatic precipitator, in addition to the rate of flow of conditioning agent, until no further improvement in opacity is measured.

Controller 32 may also provide means for determining changes in the opacity of the stack effluent that accompany such transient conditions as boiler upsets due to the incomplete combustion of coal or carbon carryover from coal combustion, ash-handling problems, precipitator rapping, boiler soot blowing and other such transient changes in operation which cannot be corrected by $SO_3$-conditioning methods.

For example, controller 32 can be programmed to sample rapidly, within each corrective sampling period of several minutes, the opacity of the stack effluent and store the stack opacity measurements within a portion of its memory dedicated to inter-period opacity measurements. Because such transient effects as boiler upsets, precipitator rapping and the like, are accompanied by rapid increases in opacity of the stack effluent, controller 32 may be programmed to calculate the rate of change of the opacity of the stack effluent during each several minutes period between the corrective samplings and to compare the calculated rate of change of the opacity of the stack effluent with a predetermined rate of change of stack effluent that corresponds to non-correctable transient effects and, if the rate of change of the opacity exceeds such a predetermined rate, to generate a "transient condition" signal that may prevent its programmed change in conditioning agent flow rate until the following corrective sampling period, or for more than one such corrective sampling period. This feature of controller 32 prevents changes in the sulfur flow rate which may otherwise be generated by the system in an effort to correct for transient conditions which need not be and cannot be corrected by the supply of conditioning agent. Controller 32 may also be provided with an algorithm upon which to base its decision on whether a change in stack effluent opacity is correctable, or may be provided with a data table and program permitting adaptive operation by which controller 32 learns from its past experiences whether a change in opacity of stack effluent is correctable.

Figure 6:
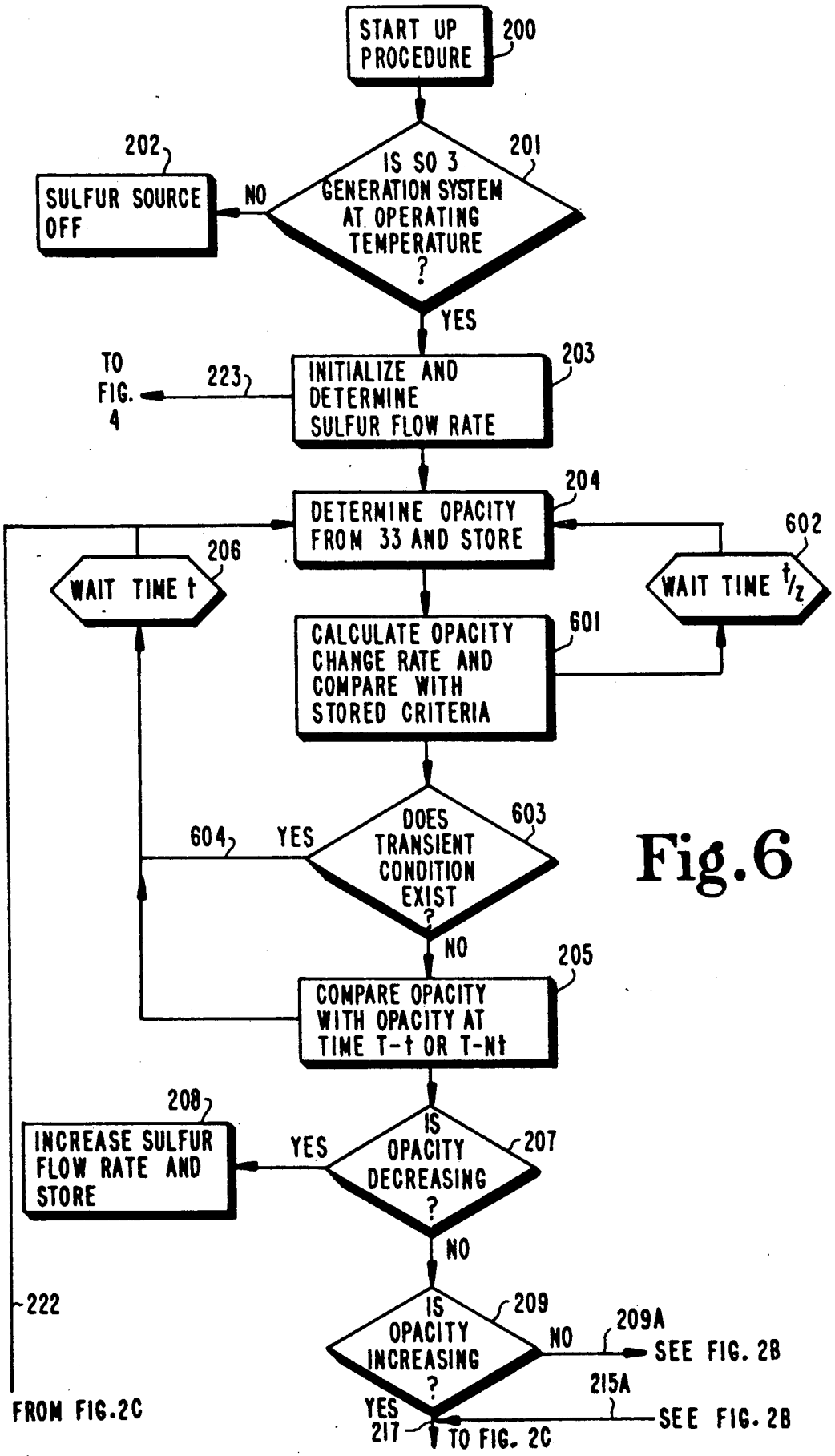
FIG. 6 is a flow chart of a subroutine that is preferably used in the program of FIGS. 2A and 2B.

FIG. 6 is a flow chart of the operating program of controller 32 with the subroutine for determining if a transient or spurious condition exists. This subroutine is shown by steps 601 through 604 which are added to the program of FIGS. 2A and 2B between steps 204 and 205. The subroutine of steps 601 through 604 prevents controller 32 from proceeding to its opacity comparison, step 205, until a subsequent corrective sampling period if and while, a transient condition signal exists.

A corrective sampling period of seven to ten minutes tends to avoid changes in conditioning agent feed rate in response to momentary transient increases in opacity due to precipitator rapping, burner malfunction, minor furnace upsets and the like; however, the use of rapid interperiod sampling of opacity measurements to determine the rate of opacity change and the generation of a transient condition signal, as set forth above and shown in FIG. 6, can permit shortening of the sampling period for corrective purposes.

Figure 2E:
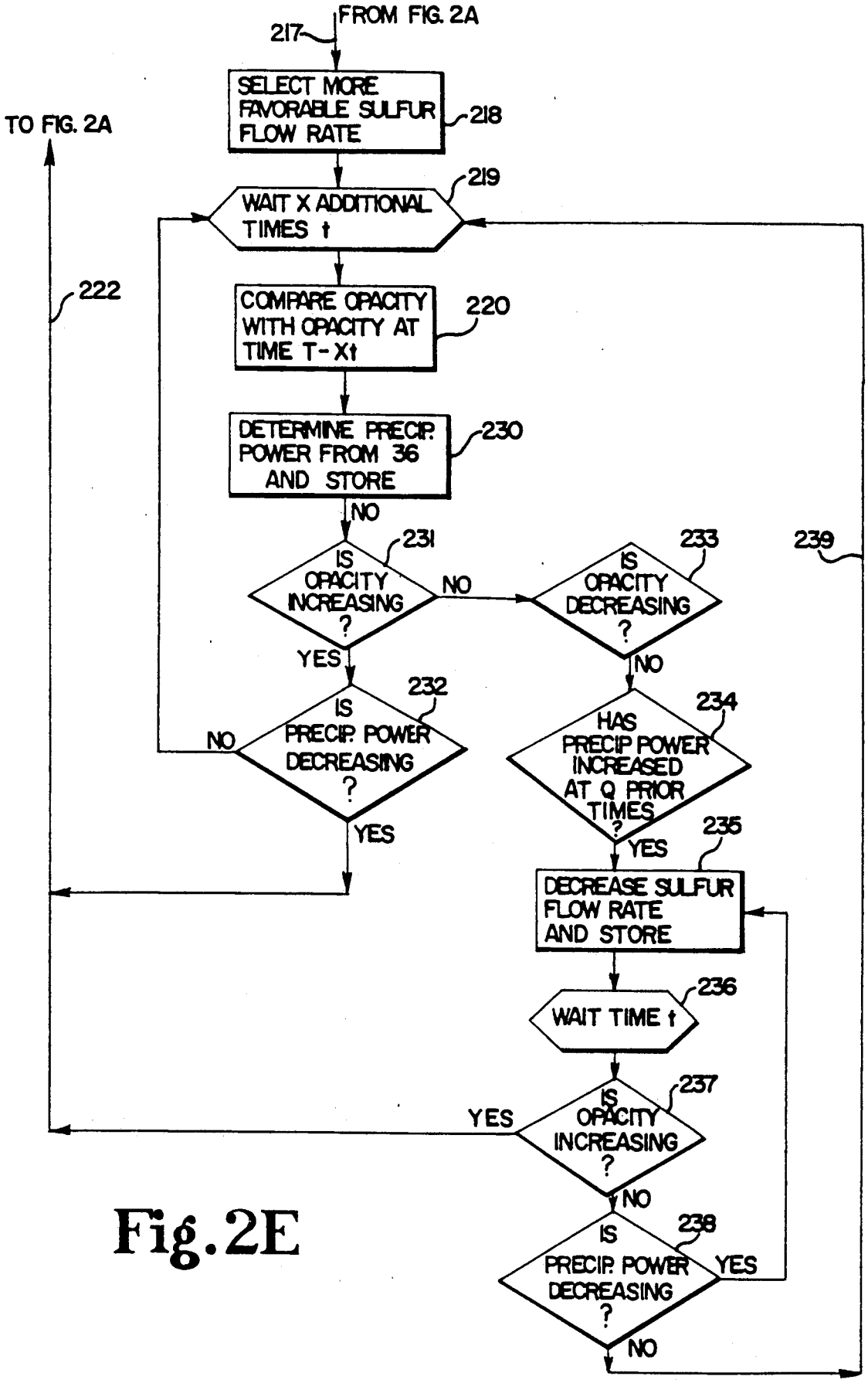
FIG. 2E is a flow chart of a subroutine that may be added to the program shown in FIGS. 2A–2C.

FIG. 2E is another flow chart of a subroutine program of controller 32 for determining if transient or spurious conditions exist after the sulfur flow rate has been initiated for normal operating conditions. This subroutine is shown by steps 230 through 238 which can be added to the program of FIGS. 2A and 2B after step 218, i.e., after the controller has determined that the system is operating at minimal opacities. In the subroutine of steps 230 through 238, the controller increases sulfur flow rate, after the normalization of an operating sulfur flow rate, only if it determines that the opacity of the stack flue gas is increasing (step 231) and the power used by the precipitator is decreasing (steps 230 and 232). The controller thereafter follows the program of FIGS. 2A and 2B until opacity is minimized (see 222). In this subroutine, the sulfur flow rate is decreased if the controller determines that the precipitator power has increased in each of a plurality (Q) of prior sampling periods (steps 230 and 234) but that the opacity has not changed (steps 231 and 233). The controller thereafter continues to decrease sulfur flow rate in successive sampling periods until it determines that precipitator power is not decreasing or that opacity is increasing (steps 235–238). If the controller determines that opacity is not increasing and precipitator power is not decreasing, it returns to step 219 (see 239). If the controller determines that opacity is increasing, it thereafter follows the program of FIGS. 2A and 2B until opacity is minimized (see 222). The subroutine shown by the flow chart in FIG. 2E can be used in place of and in addition to the subroutine shown by the flow chart of FIG. 6.

Figure 10:
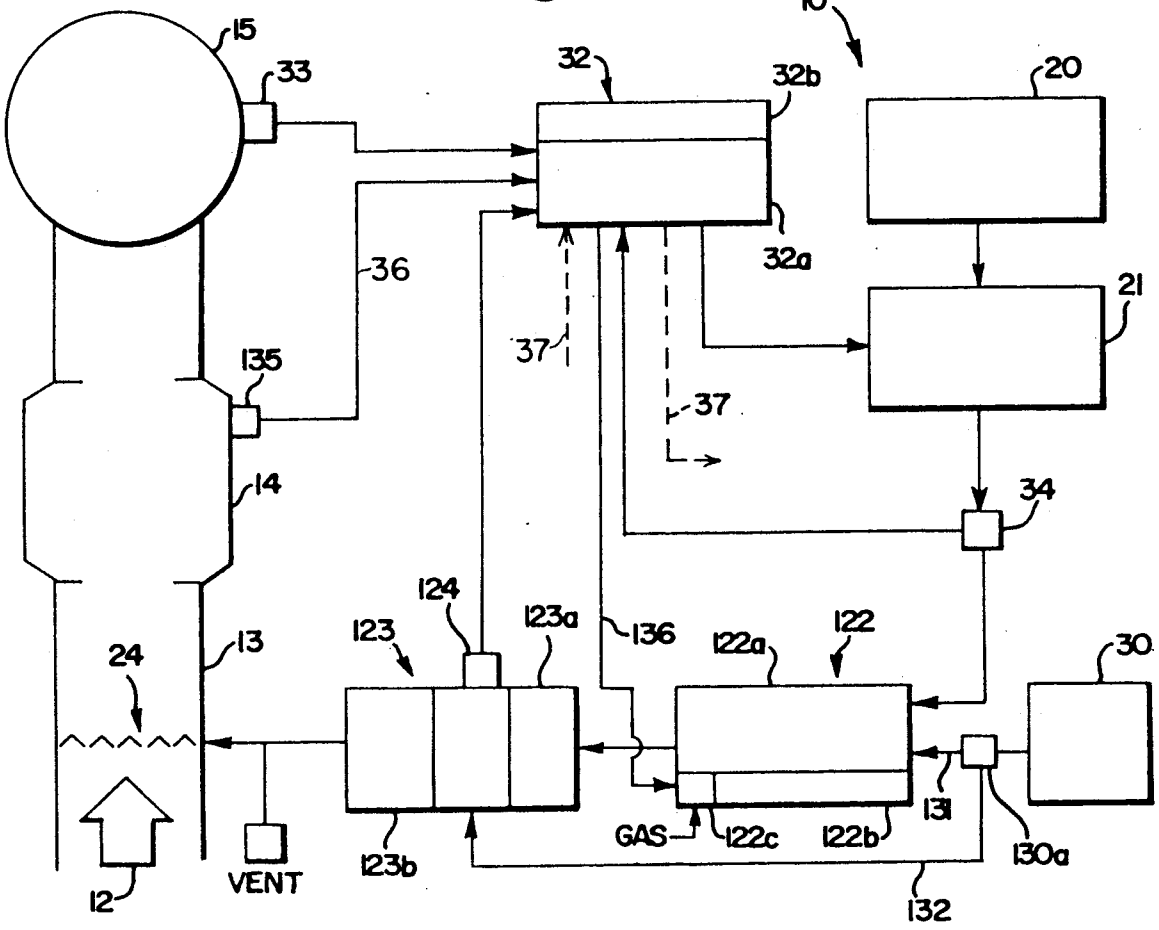
FIG. 10 is a diagrammatic drawing of another system of this invention.
Figure 9:
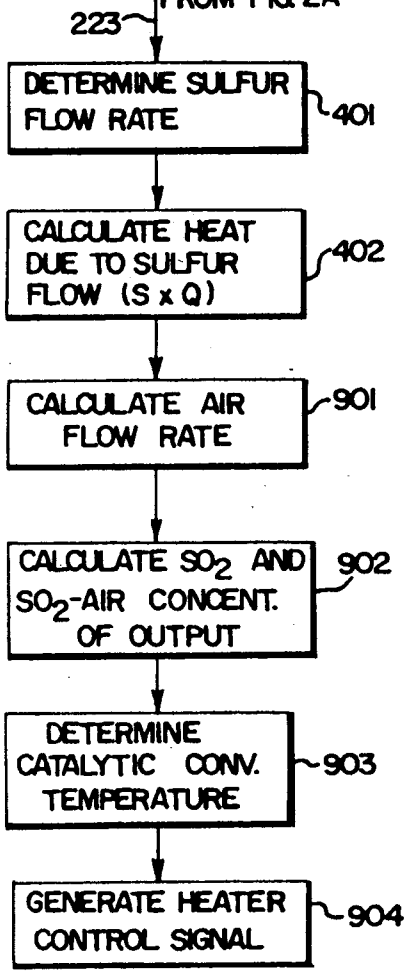
FIG. 9 is still another flow chart of a program by which a controller of this invention can operate.

FIG. 9 shows a still further operating program of controller 32 with a subroutine to improve the operating conditions for the catalytic converter. The flow chart and operating program of FIG. 9 is particularly applicable and desirable when used with the system of the invention shown in FIG. 10. The system of FIG. 10 differs from the system of FIG. 1 in several regards. The sulfur burner 122 includes a sulfur burner portion **122*a*, a gas-fired heater portion 122*b* and a controllable valve 122*c* operated by the controller 32 with the program shown in the flow chart of FIG. 9, as described below. The catalytic converter 123 includes a first stage 123*a* and a second stage 123*b* operated in accordance with this invention to maximize the efficiency of conversion of sulfur dioxide into sulfur trioxide within the catalytic converter 123. As shown in FIG. 10, a temperature sensor 124 is located to sense the temperature between the first stage 123*a* and the second stage 123*b* of the catalytic converter and to provide to controller 32 a signal proportional to the temperature between the two stages of the catalytic converter. The output of the air blower 30 is connected to a flow divider 130*a*, which directs a portion of the air flow output of blower 30 into the sulfur burner portion 122*a* through conduit 131 and directs the remainder of the air flow output of blower 30 through a conduit 132 for injection between the first and second stages of the catalytic converter as shown in FIG. 10. Finally, the system of FIG. 10 is provided with means 135 to determine the power used by the electrostatic precipitator 14 in removing particulate matter from the flue gas. The means 135 may be one or more resistors connected between ground and the high voltage output portions of the high voltage power supplies delivering power to the sections of the electrostatic precipitator 14 to sense the current provided by the one or more high voltage supplies, or the means 135 may be a current or power measuring means in the low voltage input side of the high voltage power supplies delivering power to the electrostatic precipitator 14. The signal from power determining means 135 may be used by controller 32 in the program shown by the flow chart of FIG. 2E** and described above to avoid attempts by the system to correct for spurious or transient operating conditions of the system upstream of the electrostatic precipitator which may not be cured by adjustments in sulfur flow rate.

In the system of FIG. 10, the heater **122*b* is operated by controller 32 through the use of the program shown in the flow chart of FIG. 9. In the program of FIG. 9, sulfur flow rate and the heat due to sulfur flow are determined by steps 401 and 402 in the same manner as previously described with respect to FIG. 4. In the program shown in FIG. 9, controller 32 also calculates the air flow rate into the sulfur burner portion 122*b* which, in the system shown in FIG. 10, and preferably, is constant (step 901). Controller 32 calculates, from the sulfur flow rate, the rate of sulfur dioxide generation and the sulfur dioxide-air concentration of the sulfur burner output (step 902). Controller 32 also determines the temperature from the temperature sensor 124 between the first stage 123*a* and second stage 123*b* of the catalytic converter (step 903), and from these signals generates a heater control signal (step 904) which is directed over connection 136 to operate the gas valve 122*c* and control the heating of the sulfur burner portion 122*a* by the gas heater 122*b* to obtain the best sulfur dioxide-air concentration at the output of sulfur burner 122 for input into the first stage 123*a* of the catalytic converter 123**.

The system can be provided with, for example, data entry means such as a keyboard, card reader, magnetic disc-operating system and other such means to provide controller 32 with data for operation and to permit changes in the programmed steps, the corrective sampling period, waiting time intervals and the like. For example, controller 32 may be provided with data on the opacity required to meet clean air standards and regulations. The system may also be provided, of course, with a supplementary control to prevent manual operation of the flue gas-conditioning system.

Upon startup of the system of the invention of FIGS. 1-6, the operator can push a "START" button, activating means 16 including blower means 30 and heating means 31 for providing a flow of heated air to sulfur burner 22 and catalytic converter 23 of sulfur trioxide-generating means 11. As indicated above, the air flow from heater means 31 can be on the order of 900° F. (482° C.) and have sufficient volume to bring the temperature of sulfur burner 22 and catalytic converter 23 into an operating range within a short period. When temperature sensor 35 indicates the gas exiting catalytic converter 23 is in excess of 725° F. (385° C.), for example, sensor 35 provides a signal to controller 32 which activates the electric drives for the pumps of means 21 and begins to deliver sulfur at a controlled rate from source 20 to sulfur furnace 22. Controller 40, upon receiving a signal that sulfur is being directed into sulfur burner 22, reduces the power for the electrical heaters of heater 31, or reduces the flow of fuel oil or gas to burner 41 (FIG. 3), to maintain a substantially constant thermal input to sulfur burner 22 to maintain the temperature within sulfur burner 22 within a satisfactory operating range. The system is designed so that when the temperature at the output of catalytic converter 23 exceeds 725° F. (385° C.), the temperatures within sulfur burner 22 and catalytic converter 23 are in excess of 750° F. (399° C.) and within the temperature range for the effective conversion of sulfur to sulfur trioxide. The rate at which sulfur is introduced into sulfur burner 22 by controller 32 upon startup may be set manually by the operator; or the memory **32*b* of controller 32 may be non-volatile and controller 32 may be provided with a startup algorithm to gradually increase the rate of sulfur flow to the preferred sulfur flow rate last stored in its memory before it begins its hunting for minimal stack opacity as described above and by the operating programs set forth on FIGS. 2A, 2B, 2C, 4 and 6**.

As set forth above, the functions of controller 32 and 40 are preferably combined in a single controller; and controllers 32 and 40 of the system of FIG. 1 may, of course, be connected with computer systems used by the electrical utility through additional inputs 36 and output 37 to provide, to such computer systems, data from the operation of the system of FIG. 1 to provide a history of operation of the system and to permit the operators and their computers to generate their own operating data and override or change the automatic operation of the system, if desired. Furthermore, the controllers of FIG. 1 can provide additional outputs 37 to operate digital indicators to indicate to control room personnel current operating conditions. In addition, the system, through the use of its transient condition signals, may operate annunciators and indicators for control room personnel of the electrical utility, indicating, for example, non-compliance with clean air regulations and the detection of transient conditions that affect stack effluent and air pollution. As will be apparent to those skilled in the art, controllers 32 and 40 and the variable speed controllers for means 21 may be conveniently housed in a single control enclosure adapted and located to protect the controllers from the surrounding environment.

The sulfur-burning systems of the invention described above are preferred because of economy of operation and their improved capability for being operated safely as a source of sulfur trioxide. The invention, however, can be incorporated into systems using other sources of conditioning agent and other sources of sulfur trioxide.

Figure 7:
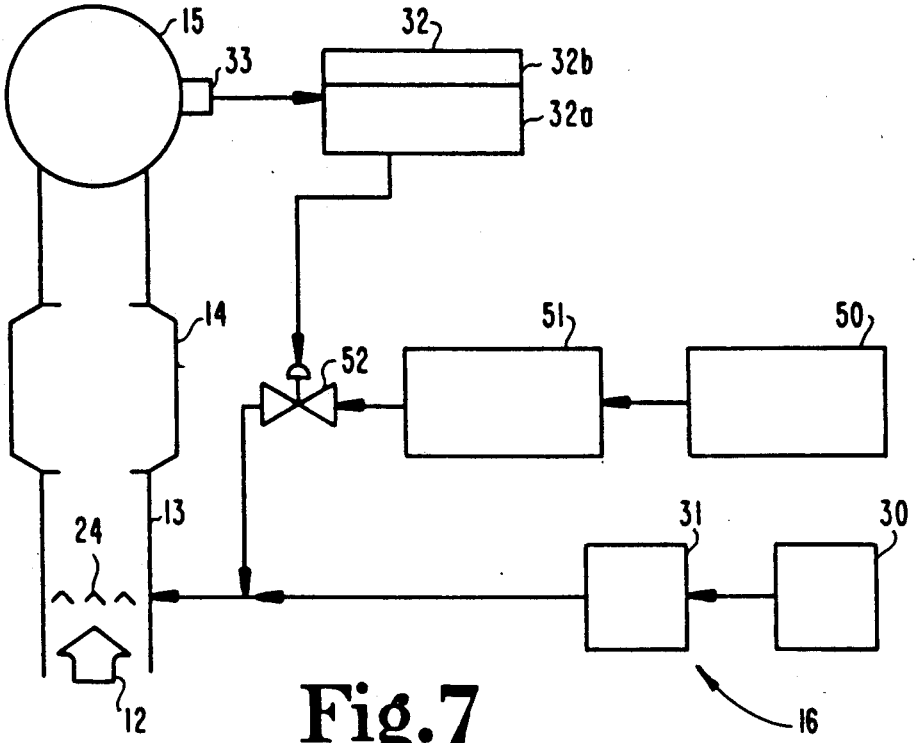
FIG. 7 is a diagrammatic drawing of another system of the invention.

FIG. 7 shows a system for providing a controlled flow of sulfur trioxide for conditioning a boiler flue gas to obtain and maintain minimal opacity of the boiler flue gas emitted from the stack. The system of FIG. 7 includes, as a source of sulfur trioxide-conditioning agent, a storage tank 50 for liquid sulfur trioxide, a vaporizer 51 to convert the sulfur trioxide from liquid to gaseous form and a control valve 52 operated by controller 32 to vary the sulfur trioxide flow rate, as described above, to maintain minimal opacity of the stack effluent. The system of FIG. 7 also includes a source of heated air 16 to maintain the sulfur trioxide gas in gaseous form downstream of control valve 52 to prevent corrosion due to condensation of the sulfur trioxide in the system. Controller 32 and opacity meter 33 operate in the same manner as described above with respect to FIGS. 1, 2A, 2B and 6 to obtain and maintain minimal opacities of the stack effluent and the source of heated air 16 is substantially the same as described above. The FIG. 7 system may be provided with a shut-off and control valve for the liquid sulfur trioxide, a damper, or air flow control, for the heated air and other control valves and gauges necessary and convenient to its operation and maintenance.

Figure 8:
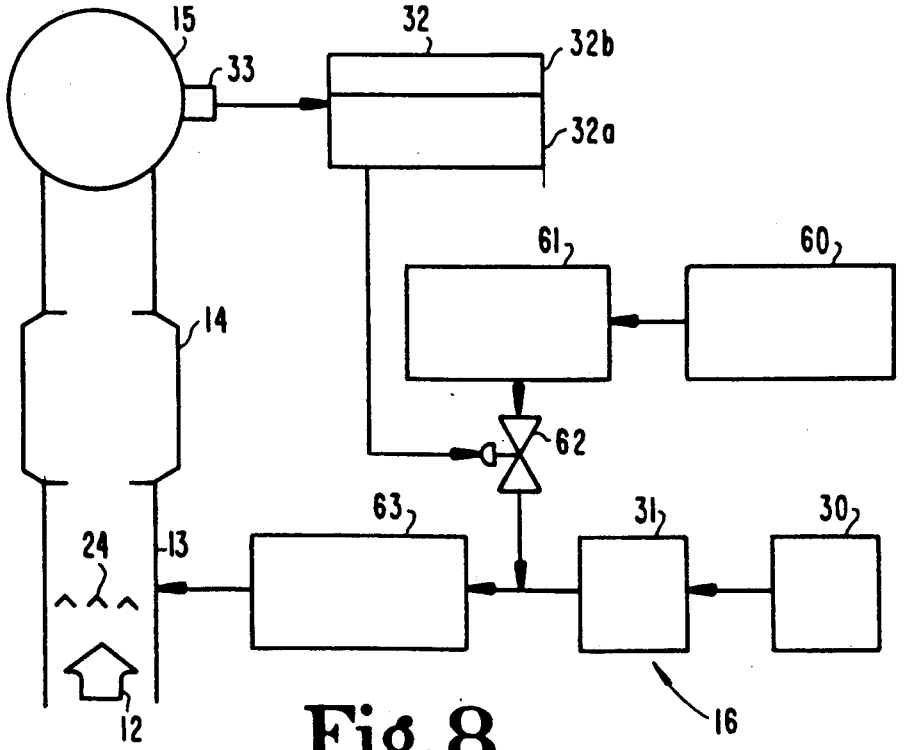
FIG. 8 is also a diagrammatic drawing of another system of the invention.

FIG. 8 shows another system for providing a controlled flow of sulfur trioxide to obtain and maintain minimal opacity of a boiler flue gas from a source of liquid sulfur dioxide. As shown in FIG. 8, the source of sulfur trioxide conditioning agent includes a storage tank 60 for liquid sulfur dioxide, a vaporizer 61 to convert the sulfur dioxide from a liquid to a gaseous state, a catalytic converter 63 to convert sulfur dioxide into sulfur trioxide and a control valve 62 operated by controller 32 to vary the sulfur dioxide flow rate to catalytic converter 63 as described above and to, accordingly, vary the sulfur trioxide flow rate to obtain and maintain minimal opacity of the stack effluent. The system of FIG. 8 also includes a source of heated air 16 to bring catalytic converter 63 up to and maintain catalytic converter 63 at, its preferred operating temperatures, e.g., 800° F. to 850° F. (427° C. to 454° C.). Such temperatures are above the temperature at which sulfur trioxide condenses within the system. Controller 32 and opacity meter 33 operate in the same manner as described above with respect to FIGS. 1, 2A, 2B and 6 to obtain and maintain minimal opacity of the stack effluent and the source of heated air 16 is substantially the same as described above. Of course, the FIG. 8 system may be provided control valves and gauges necessary and convenient to its operation and maintenance.

Figure 11:
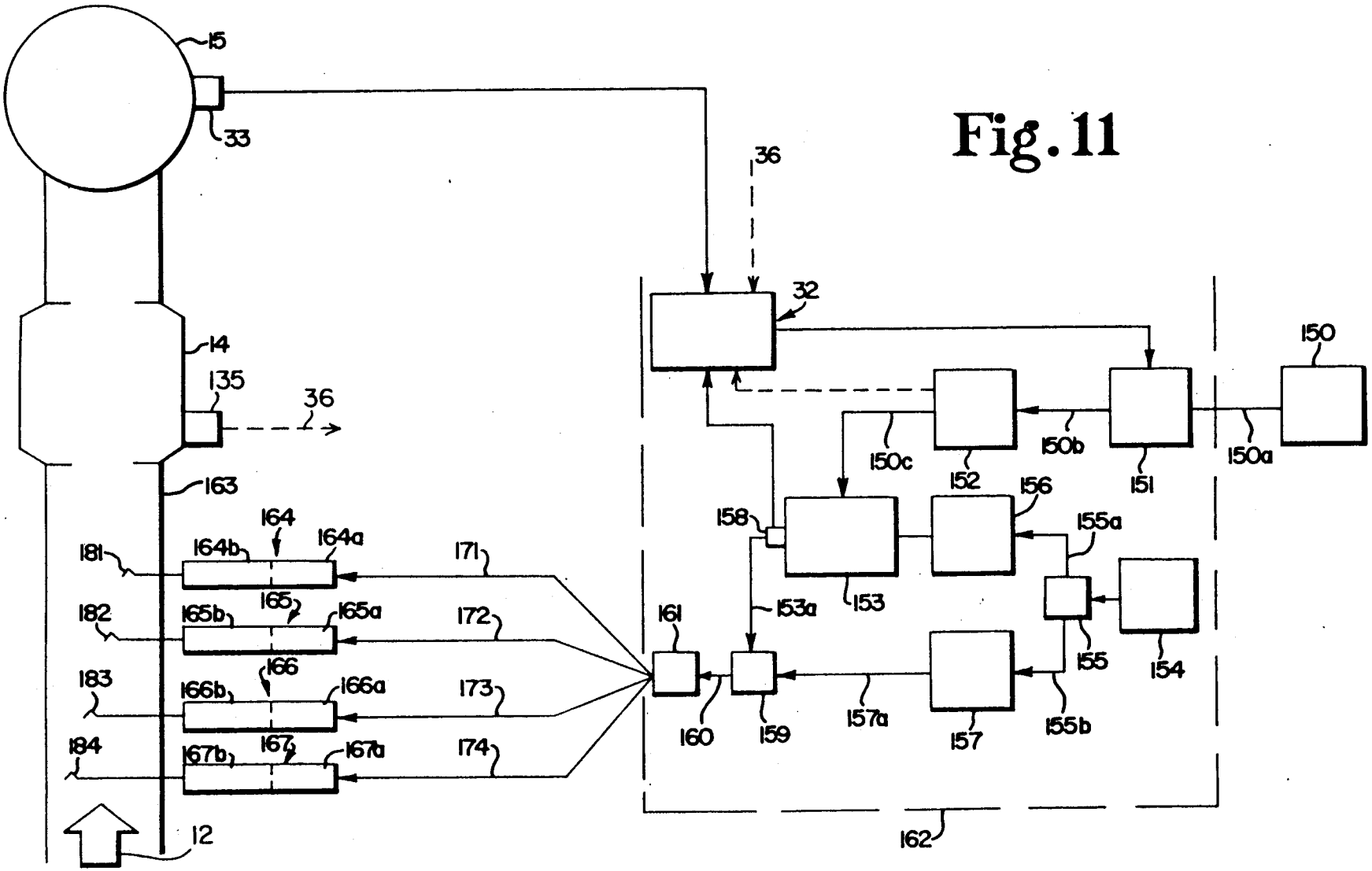
FIG. 11 is a diagrammatic drawing of still another system of this invention.

FIG. 11 shows still another system of the invention. The new system shown in FIG. 11 includes a source of liquefied sulfur 150 which may include a concrete storage pit or a thermally insulated tank that is provided with heating elements to liquefy the sulfur. In the system, liquefied sulfur will be pumped by a metering pump 151 from the sulfur source 150 through steam-jacketed and thermally insulated pipes **150*a*-150*c* and a mass flow meter 152 (which is optional) to a sulfur burner, or furnace, 153 for combustion. The sulfur burner 153 can be a conventional sulfur furnace construction with a refractory lining and a brick checker work. Preferably, the sulfur burner of the system can be a spray burner in which the liquefied sulfur is sprayed into the refractory furnace from one or more spray nozzles. Such spray burner systems provide more vigorous burning and more complete combustion than the conventional checkerwork furnaces, and the spray burner apparatus is smaller, less expensive and more easily controlled, and permits the burning of sulfur to be terminated quickly if necessary. The products of combustion of the sulfur, primarily sulfur dioxide, will be directed from the sulfur burner 153 through conduit 153***a* and mixed with air from conduit 157*a*, as described below.

The system shown in FIG. 11 includes a constant volume blower 154. The constant volume blower 154 provides a flow of air to a flow divider 155 which divides the air flow between two conduits 155*a* and 155*b* to air heaters 156 and 157. The air flow from blower 155 through conduit 155*a* is raised in temperature by air heater 156 to a constant temperature of 750° F. at the heater output and is directed into the sulfur burner 153 to raise the sulfur burner 153 to a temperature sufficient to burn sulfur, that is, approximately 750° F. A temperature sensor 158 at the output of the sulfur burner 153 is set to provide an operating signal to controller 32 when the temperature at the output of the sulfur burner exceeds 600° F. When controller 32 receives the signal from temperature sensor 158 indicating the air leaving the sulfur burner 153 exceeds 600° F., the controller 32 will be enabled to operate sulfur pump 151, as described above, to operate the system at minimal opacities and minimal sulfur flow rates. During operation of the system, controller 32 operates sulfur pump 151 to deliver liquefied sulfur from sulfur source 150 through a flow meter 152 (which is optional) to sulfur burner 153. In sulfur burner 153, the sulfur is mixed with the air from air heater 156 and combusted to create combustion products, primarily $SO_2$, which are directed from the output of the sulfur burner 153 through conduit 153*a*.

The system of FIG. 11 requires no control of the temperature or of the volume of air introduced into sulfur burner 153 by blower 155 and air heater 156. Under all conditions of operation of controller 32 and sulfur burner 153, a constant flow of air at an effective burner input temperature of 750° F. can be introduced into sulfur burner 153. The air from blower 154 is split into conduits 155*a* and 155*b* in a constant proportion. The flow rate of air introduced into conduit 155*a*, air heater 156 and sulfur burner 153 is only that flow rate sufficient to burn sulfur and may typically be as low as 40 to 50 standard cubic feet per minute, which substantially reduces the power requirements for air heater 156. Blower 154 and divider 155 deliver a larger volume rate of the air into conduit 155*b* and heater 157, for example, about 850 standard cubic feet per minute, to mix with and dilute the sulfur dioxide leaving burner 153. Air heater 157 raises the temperature of this larger proportion of air slightly, to about 100° F., a temperature sufficient to maintain the sulfur dioxide and air combination above the condensation temperature of sulfurous acid after mixing. The second flow of heated air is delivered through conduit 157*a* to a mixing junction 159 where it is mixed with the sulfur dioxide leaving sulfur burner 153 through conduit 153*a*. The combined air-sulfur dioxide mixture will then travel through conduit 160 to a flow divider 161.

Thus, the air from blower 154 is split between conduits 155*a* and 155*b*, with the air flow through air heater 156 and sulfur burner 153 being only five to ten percent of the air flow and with the remaining ninety to ninety-five percent of the air flow being directed through conduit 155*b* and air heater 157. This proportion will provide, upon mixing of the $SO_2$ from conduit 153*a* and the slightly heated air from conduit 157*a*, an air-$SO_2$ concentration suitable for conversion to sulfur trioxide.

In this preferred embodiment of the invention, the sulfur pump 151, flow meter 152, sulfur burner 153, blower 154, flow divider 155, air heater 156, air heater 157, conduits 150*b*, 150*c*, 153*a*, 155*a*, 155*b* and 157*a*, mixing junction 159 and flow divider 160 may be supported and carried by a single supporting structure or means, which is indicated at 162, and can all be integrated into a single assembly which may be located remotely from the duct work 163 for the flue gas. The integrated assembly can also include an insulated and heated tank (as sulfur source 150) which is supported and carried with conduit 150*a* by the supporting structure 162. Such an integrated assembly may be conveniently built and tested at a production facility located distantly from the site of its installation and may be shipped as a unit for installation. In this preferred system, the temperature of the air-$SO_2$ mixture downstream of the mixing junction 159 need only be maintained in excess of the relatively low temperature at which the air-$SO_2$ mixture will condense to form sulfurous acid (about 180° F.). Conduit 160 for the air-$SO_2$ mixture may be mild steel pipe with sufficient thermal insulation to insure that the temperature of the air-$SO_2$ mixture remains above 180° F.

The system of FIG. 11 includes a plurality of sulfur dioxide conversion means, 164–167, preferably one for each $SO_3$ insertion site in conduit 163. The air-$SO_2$ mixture is divided by a flow divider 160 into a plurality of conduits, 171–174, for delivering to the location adjacent the plurality of sulfur dioxide conversion means, 164–167, where it is heated to 800° F., converted to $SO_3$, and delivered to a plurality of $SO_3$ insertion devices 181–184. Each of the plurality of sulfur dioxide conversion means 164–167 includes a small heater, 164*a*–167*a*, respectively, and a small catalytic converter 164*b*–167*b*, to convert sulfur dioxide into sulfur trioxide immediately adjacent the plurality of insertion probes 181–184. The air-$SO_2$ mixture in each of conduits 171–174 is directed into the small heaters 164*a*–167*a*, which include self-contained temperature regulators to raise the output temperature of the air-$SO_2$ mixture to 800° F., prior to its entry into the plurality of catalytic converters 164*b*–167*b* where the $SO_2$ is converted to $SO_3$ and immediately injected into duct work 163 through the injection devices 181–184.

The sulfur trioxide is mixed with the boiler flue gas and its entrained particulate matter to condition the particulate matter for removal by the electrostatic precipitator 14. The electrostatic precipitator is operated to remove particulate matter from the boiler flue gas before it is emitted into atmosphere from the stack 13.

The invention thus provides an improved apparatus for conditioning boiler flue gas with sulfur trioxide for removal of entrained particles with an electrostatic precipitator. Such improved apparatus includes an integrated assembly adapted for providing a flow of air and sulfur dioxide at a temperature in excess of the condensation temperature of sulfurous acid. The integrated assembly includes first means for providing a flow of sulfur dioxide, second means for providing a flow of heated air, third means for mixing the flows of sulfur dioxide and heated air to produce a combined flow of sulfur dioxide and air at a temperature in excess of the condensation temperature of sulfurous acid and for dividing the flow of sulfur dioxide and air into a plurality of flows for conversion to sulfur trioxide and injection into the boiler flue gas at a plurality of injection sites upstream of the electrostatic precipitator, and fourth means for supporting and carrying said first, second and third means as an integrated assembly. In a preferred integrated assembly of such apparatus, the first means comprises a sulfur pump, a sulfur burner having a sulfur input and air input and a sulfur dioxide output, and an insulated conduit interconnecting the sulfur pump and the sulfur input of the sulfur burner, an air blower and air flow divider connected with the air blower and having a first output and a second output, a first heater, a first air conduit means interconnecting the first output of the air divider and first heater with the air input of the sulfur burner. The second means comprises a second heater, a second air conduit means interconnecting the second output of the air divider and second heater with the sulfur dioxide output of the sulfur burner. In some installations, the first means can include the sulfur source and insulated conduits leading to the sulfur pump.

In the improved apparatus, a plurality of relatively compact sulfur dioxide conversion means are adapted for support and location remote from the integrated assembly at injection sites for sulfur trioxide upstream of the electrostatic precipitator. Each sulfur dioxide conversion means comprises a heater and a catalytic converter adapted for connection with one of the plurality of flows of sulfur dioxide and air, and the heaters and catalytic converters have a physical size and a heating and conversion capacity permitting their close location to one of the injection sites for sulfur trioxide.

In the system shown in FIG. 11, opacity controller 32 can control the rate at which the sulfur-metering pump 151 delivers liquid sulfur to the sulfur burner 153 and can operate to maintain a minimal opacity of the flue gasses passing through the stack 13 and to ignore transient and spurious conditions as shown and described above using the programs of FIGS. 2A–2E, 5A–5C, 6 and 9.

Systems of the invention, including the new control methods and apparatus, are uncomplicated, are capable of an effective supply of sulfur trioxide for conditioning boiler flue gas prior to its passage through an electrostatic precipitator, and are controllable to maintain a minimal opacity of the flue gasses that pass into atmosphere from the boiler stack. The invention provides a non-complex, direct system for providing minimal opacity of stack effluents and minimal pollution from boiler flue gas particulate matter.

While a presently preferred embodiment and other less preferred embodiments of the invention are described above, those skilled in the art will recognize that other embodiments are possible without departing from the scope of the following claims.

I claim:

1. In a system for conditioning boiler flue gas with sulfur trioxide for removal of entrained particles with an electrostatic precipitator, including means to provide a controlled flow of sulfur dioxide and air at a temperature only in excess of the condensation temperature of sulfurous acid, the improvement comprising:

means to divide the flow of air and sulfur dioxide into a plurality of air-sulfur dioxide flows of reduced volume;

a plurality of sulfur dioxide converter assemblies, each sulfur dioxide converter assembly comprising a small heater for the flow of air and sulfur dioxide and a contiguous small catalytic converter, said heater and catalytic converter having a heating capacity and $SO_3$ conversion capacity sufficient for the reduced volume of one of the plurality of air-sulfur dioxide flows.

2. The apparatus of claim 1 wherein said first means comprises a sulfur pump, a sulfur burner having a sulfur input and air input and a sulfur dioxide output, and an insulated conduit interconnecting said sulfur pump and the sulfur input of said sulfur burner, an air blower and air flow divider connected with said air blower and having a first output and a second output, a first heater, and a first air conduit means interconnecting said first output of the air divider and first heater with the air input of the sulfur burner; and said second means comprises a second heater, and a second air conduit means interconnecting said second output of the air divider and second heater with the sulfur dioxide output of the sulfur burner.

3. The apparatus of claim 2 wherein said air divider directs about 5% to about 10% of the air blower output to the first output and about 90% to about 95% of the air blower output to the second output.

4. The apparatus of claim 3 wherein said first heater has capacity to heat the air from the first output of the blower to temperatures in excess of about 750° F. and said second heater has capacity to heat the air from the second output to temperatures in excess of about 100° F.

5. Apparatus for conditioning flue gas with sulfur trioxide for removal of entrained particles with an electrostatic precipitator, comprising:

means for providing a flow of sulfur dioxide gas in air, including a sulfur burner, means for providing said sulfur burner with a flow of air, means for providing said sulfur burner with a flow of sulfur, and means for heating said sulfur burner;

a catalytic converter comprising a first catalytic converter stage and a second catalytic converter stage;

means for introducing a flow of air between said first catalytic converter stage and said second catalytic converter stage;

a temperature sensor for measuring the temperature between the first catalytic converter stage and the second catalytic converter stage; and a controller connected with said means for providing the sulfur burner with a flow of sulfur, said means for heating said sulfur burner and said temperature sensor, said controller being programmed to calculate the concentration of sulfur dioxide in air and operate said means for heating the sulfur burner in response to the temperature between the first stage and second stage of the catalytic converter to maintain and improve the efficient conversion of sulfur dioxide and air to sulfur trioxide.

6. The apparatus of claim 5 wherein the means for heating the sulfur burner comprises a gas-fired heater and a controllable valve connected with said controller to vary the flow of gas to said gas-fired heater.

7. The apparatus of claim 5 wherein said means for providing a flow of sulfur dioxide in air and said controller are part of an integrated assembly for installation at a first convenient location and said two-stage catalytic converter and temperature sensor are part of an integrated assembly for installation at a remote location.

8. The apparatus of claim 5 wherein said controller is connected with an opacity sensing means to determine the opacity of the flue gas and with means to determine the power used by the electrostatic precipitator, said controller periodically sampling the opacity of the flue gas, the corresponding rate of flow of the sulfur and the power used by the electrostatic precipitator, and storing data on the opacity, the rate of sulfur flow and the precipitator power;

operating at a sulfur flow rate corresponding to a predetermined minimal opacity while continuing to periodically sample the opacity, and precipitator power, and increasing the rate of sulfur flow if the opacity of the stack effluent increases and the power used by the electrostatic means decreases and continually increasing the rate of flow of sulfur in response to opacity data until the opacity of the stack effluent fails to decrease or increases, and reducing the rate of sulfur flow in the event that the precipitator power increases at a plurality of sampling periods and the opacity of the stack effluent remains unchanged and continually decreasing the rate of sulfur flow in response to precipitator power data until the opacity of the stack effluent increases or the precipitator power fails to decrease.

9. A system for conditioning boiler flue gas with sulfur trioxide for removal of entrained particles with an electrostatic precipitator, comprising:

means for providing a controlled flow of sulfur dioxide and air at a temperature in excess of the condensation temperature of sulfurous acid;

means for dividing the flow of air and sulfur dioxide into a plurality of air-sulfur dioxide flows of reduced volume;

a plurality of sulfur dioxide converter assemblies, each sulfur dioxide converter assembly comprising a temperature control means for the flow of air and sulfur dioxide and a contiguous small catalytic converter, said temperature control means and catalytic converter providing a temperature and $SO_3$ conversion sufficient for the reduced volume of one of the plurality of air-sulfur dioxide flows;

a controller connected with opacity sensing means to determine the opacity of the flue gas and with precipitator power sensing means to determine the power used by the electrostatic precipitator, said controller periodically sampling the opacity of the flue gas, the corresponding rate of flow of the sulfur dioxide and the power used by the electrostatic precipitator, and storing data on the opacity, the rate of sulfur dioxide flow and the precipitator power;

operating at a sulfur dioxide flow rate corresponding to a predetermined minimal opacity while continuing to periodically sample the opacity, and precipitator power, and increasing the rate of sulfur dioxide flow if the opacity of the stack effluent increases and the power used by the electrostatic means decreases and continually increasing the rate of flow of sulfur dioxide in response to opacity data until the opacity of the stack effluent fails to decrease or increases, and reducing the rate of sulfur dioxide flow in the event that the precipitator power increases at a plurality of sampling periods and the opacity of the stack effluent remains unchanged and continually decreasing the rate of sulfur dioxide flow in response to precipitator power data until the opacity of the stack effluent increases or the precipitator power fails to decrease.

10. The system of claim 9 wherein said means for providing a controlled flow of sulfur dioxide gas and air comprises a sulfur burner, means for providing said sulfur burner with a flow of air, means for providing said sulfur burner with a flow of sulfur, and means for heating said sulfur burner.

11. The apparatus of claim 10 wherein the means for heating the sulfur burner comprises a gas-fired heater and a controllable valve connected with said controller to vary the flow of gas to said gas-fired heater.

12. The apparatus of claim 9 wherein said means for providing a controlled flow of sulfur dioxide and air and said controller are part of an integrated assembly for installation at a first convenient location, and said plurality of sulfur dioxide converter assemblies are adapted for installation at a remote location.

13. The system of claim 9 further comprising:

means for determining the sulfur content of the boiler fuel; and means for providing data on the sulfur content of the boiler fuel to said controller, said controller varying the rate of conditioning agent flow to compensate for changes in the sulfur content of the boiler fuel.

14. Apparatus for conditioning flue gas with sulfur trioxide for removal of entrained particles with an electrostatic precipitator, comprising:

means for providing a flow of sulfur dioxide gas and air, including a source of sulfur dioxide gas, means for providing said source of sulfur dioxide gas with a flow of air, and means for heating said flow of sulfur dioxide gas and air;

a catalytic converter comprising a first catalytic conversion stage and a second catalytic conversion stage;

a temperature sensor for measuring the temperature between the first catalytic converter stage and the second catalytic converter state; and a controller connected with said means for providing a flow of sulfur dioxide gas and air, with said means for heating said flow of sulfur dioxide gas and air and with said temperature sensor, said controller being programmed to calculate the concentration of sulfur dioxide in air and operate said means for heating said flow of sulfur dioxide gas and air in response to the temperature between the first stage and second stage of the catalytic converter to maintain and improve the efficient conversion of sulfur dioxide and air to sulfur trioxide.

15. The apparatus of claim 14 wherein the apparatus further includes a means for determining the sulfur content of the boiler fuel and for providing data on the sulfur content of the fuel, said sulfur content-determining means being connected with said controller, and wherein said controller is programmed to provide means for storing the data on the sulfur content of the fuel and for varying the operation of said means for providing a flow of sulfur dioxide gas and air to accommodate changes in the sulfur content of the boiler fuel.

16. The apparatus of claim 14 further comprising means for periodically sampling and determining flue gas opacity and the power supplied to the electrostatic precipitator, said controller being further programmed to provide means for storing data on opacity and the power supplied to said electrostatic precipitator and for controlling the removal of entrained particles by the electrostatic precipitator by increasing and decreasing the flow of sulfur dioxide gas to maintain minimal stack opacity.

17. The apparatus of claim 14 further comprising means for introducing a flow of air between said first catalytic converter stage and said second catalytic converter stage.

18. The apparatus of claim 17 wherein said means for introducing a flow of air between said first catalytic converter stage and said second catalytic converter stage comprises said means for providing said source of sulfur dioxide gas with a flow of air.

* * * * *

UNITED STATES PATENT AND TRADEMARK OFFICE

CERTIFICATE OF CORRECTION

PATENT NO. : 5,032,154

DATED : July 16, 1991

INVENTOR(S) : Robert A. Wright

It is certified that error appears in the above-identified patent and that said Letters Patent is hereby corrected as shown below:

Title Page:

In the Abstract, line 14, delete "$SO_2$ 1 into SO3," and insert therefor --$SO_2$ into $SO_3$--.

In col. 26, line 42, change "state" to --stage--.

Signed and Sealed this

Eighth Day of December, 1992

*Attest:*

DOUGLAS B. COMER

*Attesting Officer*

*Acting Commissioner of Patents and Trademarks*